US006227207B1

(12) United States Patent
Stachowski

(10) Patent No.: US 6,227,207 B1
(45) **Date of Patent: *May 8, 2001**

(54) FLIP CLIP HAIR STYLING APPARATUS AND METHODS

(76) Inventor: Barbara C. Stachowski, 11 El Gavilan, Orinda, CA (US) 94563

( * ) Notice: Subject to any disclaimer, the term of this patent is extended or adjusted under 35 U.S.C. 154(b) by 0 days.

This patent is subject to a terminal disclaimer.

(21) Appl. No.: 09/416,738

(22) Filed: Oct. 13, 1999

Related U.S. Application Data

(63) Continuation-in-part of application No. 09/172,093, filed on Oct. 13, 1998.

(51) Int. Cl.[7] ..... A45D 8/04
(52) U.S. Cl. ..... 132/273
(58) Field of Search ..... 132/273, 245, 132/246, 247, 275, 55, 277, 279, 280, 284, 276, 53, 54; 63/3, 5.1, 11, 6

(56) References Cited

U.S. PATENT DOCUMENTS

| | | | | |
|---|---|---|---|---|
| 1,512,490 | | 10/1924 | Scheanblum . | |
| 2,066,709 | | 1/1937 | Adams . | |
| 2,262,478 | | 11/1941 | Thompson . | |
| 2,720,207 | | 10/1955 | Burtnett . | |
| 3,078,855 | * | 2/1963 | Lovret | 132/246 |
| 3,410,023 | * | 11/1968 | Anello | 63/11 |
| 3,915,203 | | 10/1975 | Solomon . | |
| 4,830,029 | * | 5/1989 | Bird | 132/54 |
| 4,966,173 | * | 10/1990 | Russell | 132/54 |
| 5,318,054 | * | 6/1994 | Neilson et al. | 132/273 |
| 5,499,638 | | 3/1996 | Ripley . | |
| 5,822,798 | * | 10/1998 | Baxley | 132/273 |
| 5,833,335 | | 11/1998 | Voughlohn . | |
| 5,857,217 | | 1/1999 | Hsueh . | |
| 5,868,147 | * | 2/1999 | Davidson | 132/251 |
| 5,899,211 | * | 5/1999 | Brown | 132/201 |

FOREIGN PATENT DOCUMENTS

| | | |
|---|---|---|
| 797281 | 2/1936 | (FR) . |

* cited by examiner

*Primary Examiner*—Jeffrey A. Smith
*Assistant Examiner*—Eduardo C. Robert
(74) *Attorney, Agent, or Firm*—Lumen Intellectual Property Services

(57) ABSTRACT

A hair styling device and method utilizes a spring strip having a stable open state and a coiled closed state. In the open state the strip is elongated and is capable of being positioned against, through, or around sections of hair. The strip is then actuated to coil and hold the sections of hair in styles. In preferred embodiments, the device comprises a carbon steel spring strip and a holding member for holding a section of hair against the spring strip during styling. The preferred device is capable to generate a variety of hairstyles through the coiling action of the spring strip or spring strips used. In one embodiment the device comprises two spring strips attached to each other at one end and coated with a material having a textured surface to prevent hair from slipping. In another embodiment a spring strip has a stretchable section attached at the ends of a spring strip for holding a section of hair against the spring strip during styling. Alternatively, a plurality of spring strips are connected through a body structure such that the spring strips coil in the same direction and act together as a claw or clamping device to hold sections of hair. Thin elongated coiling hair sticks and spring strips used in combination with elastic loops are also described.

18 Claims, 22 Drawing Sheets

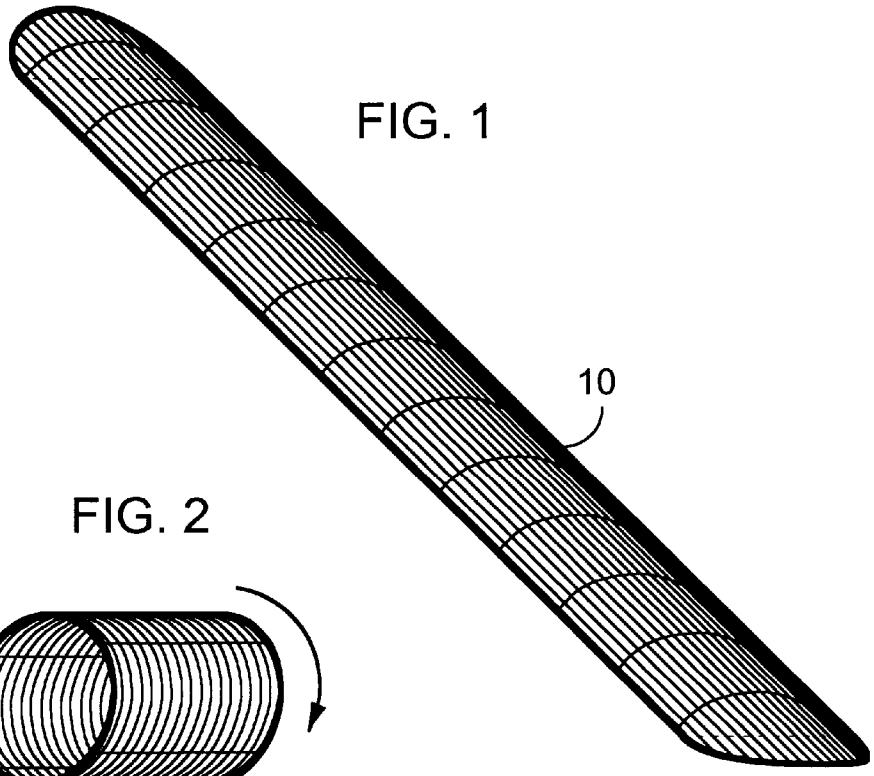
FIG. 1
FIG. 2
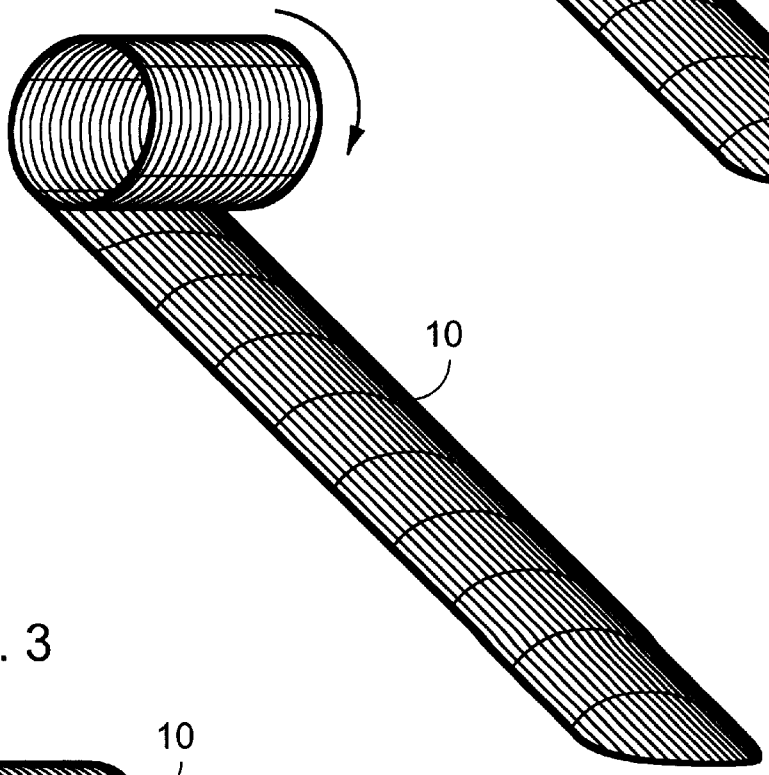
FIG. 3
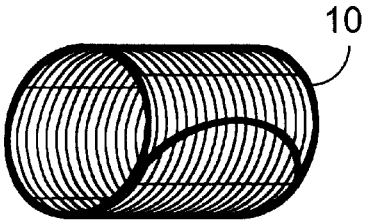

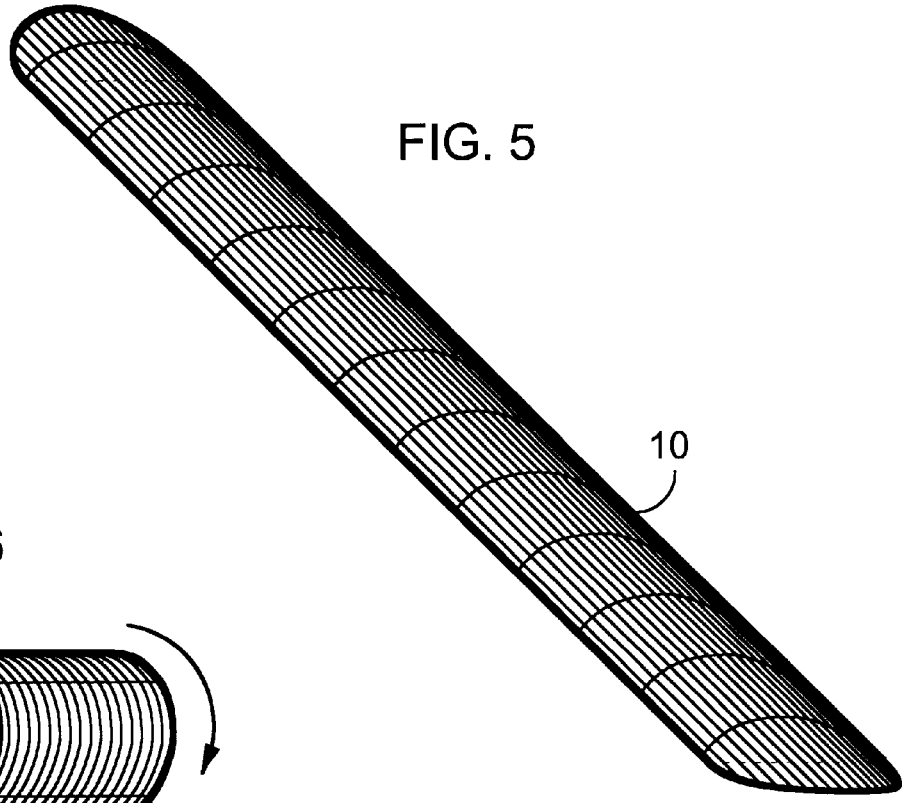
FIG. 5
FIG. 6
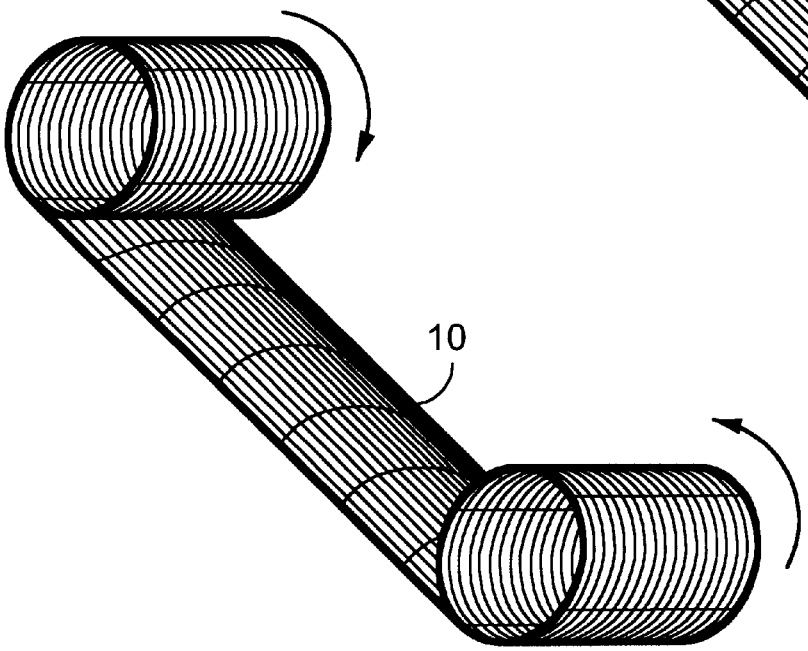
FIG. 7
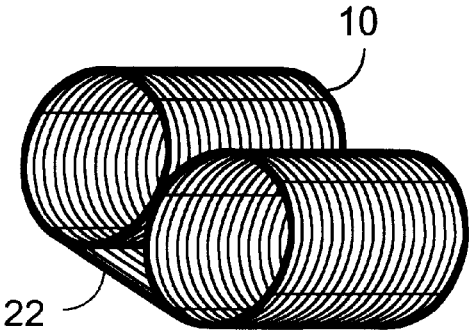

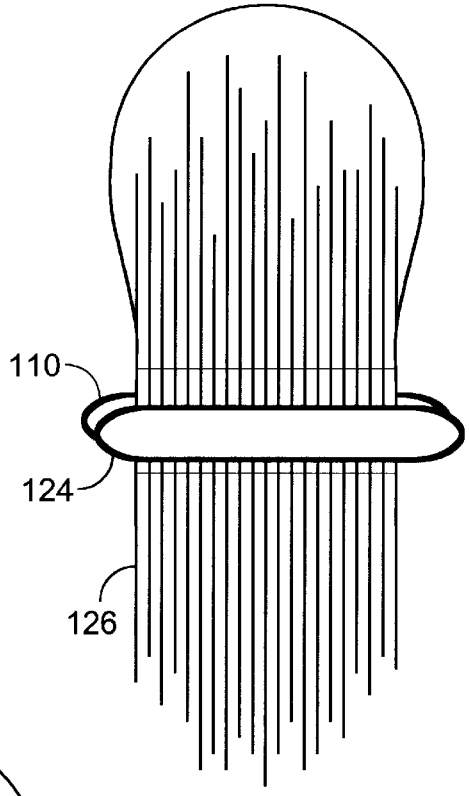
FIG. 18a
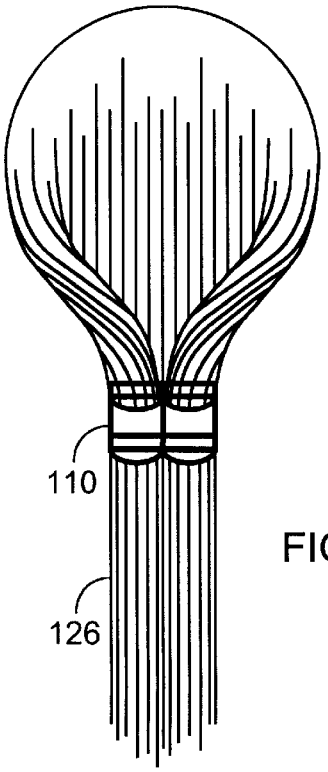
FIG. 18b
FIG. 18c
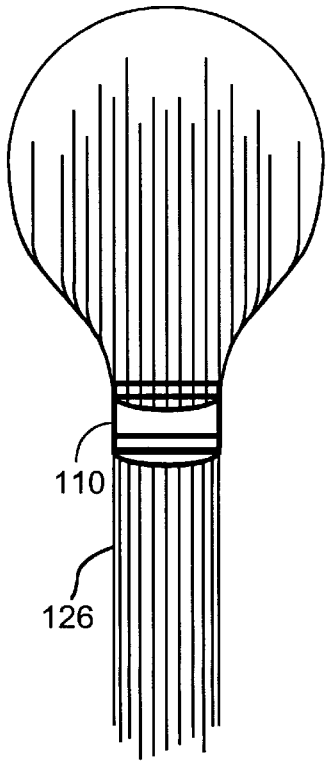

FIG. 22a
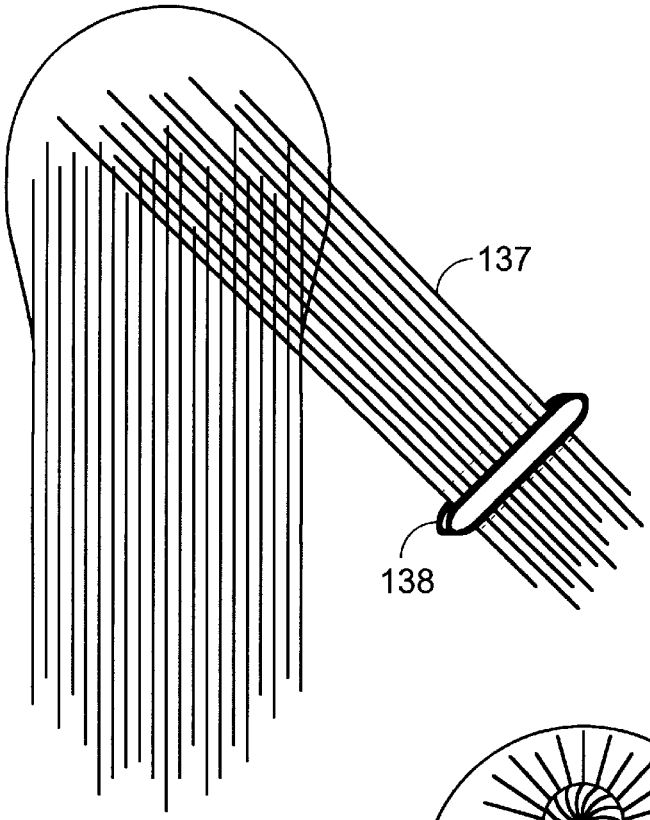
FIG. 22c
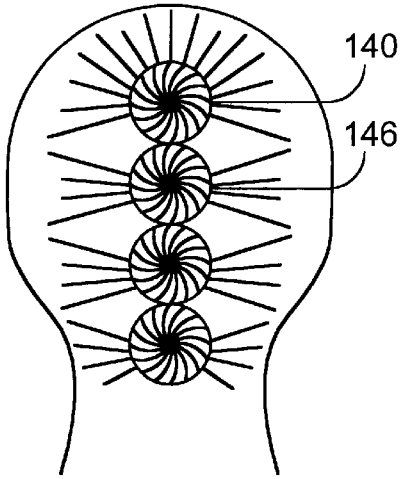
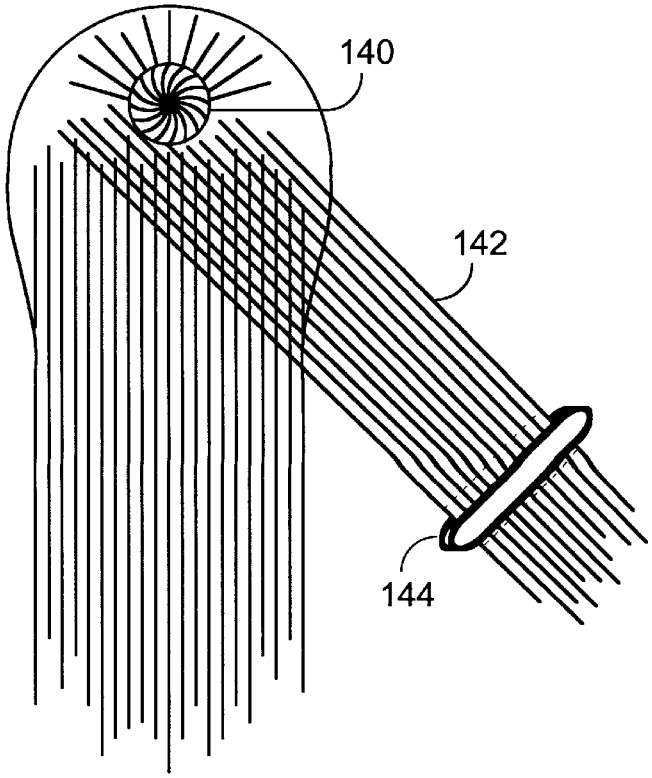
FIG. 22b

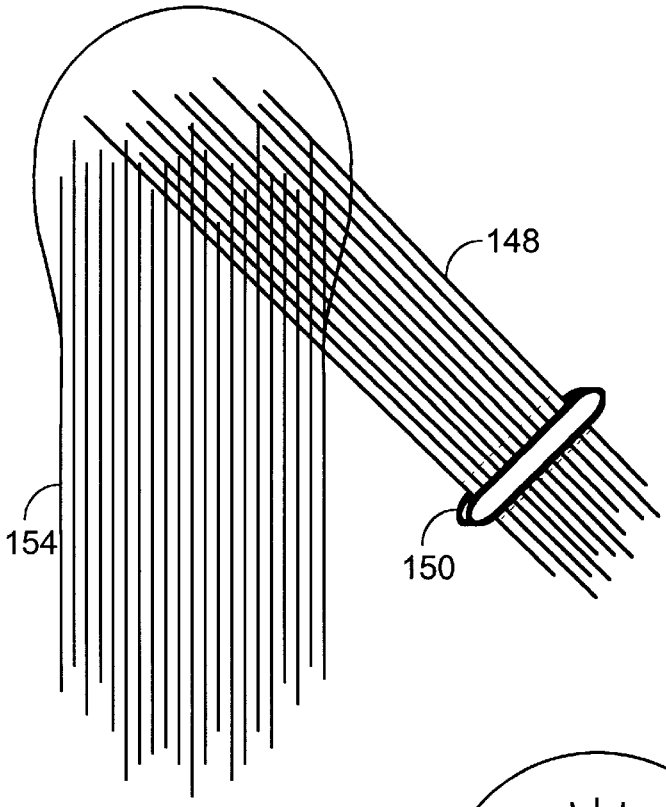
FIG. 23a
FIG. 23c
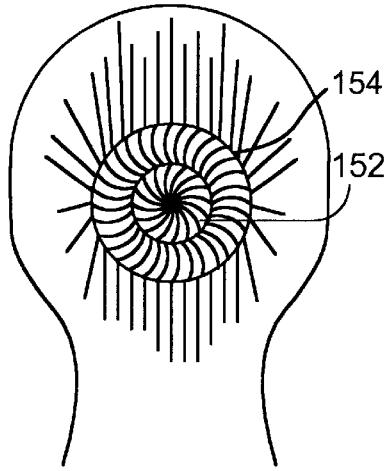
FIG. 23b
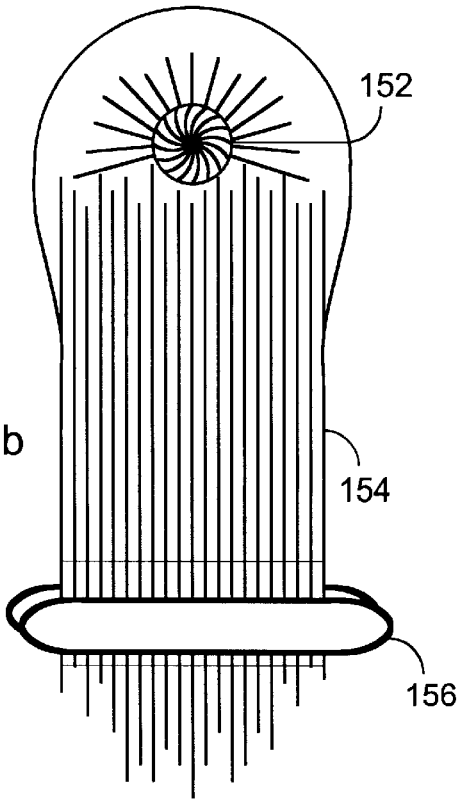

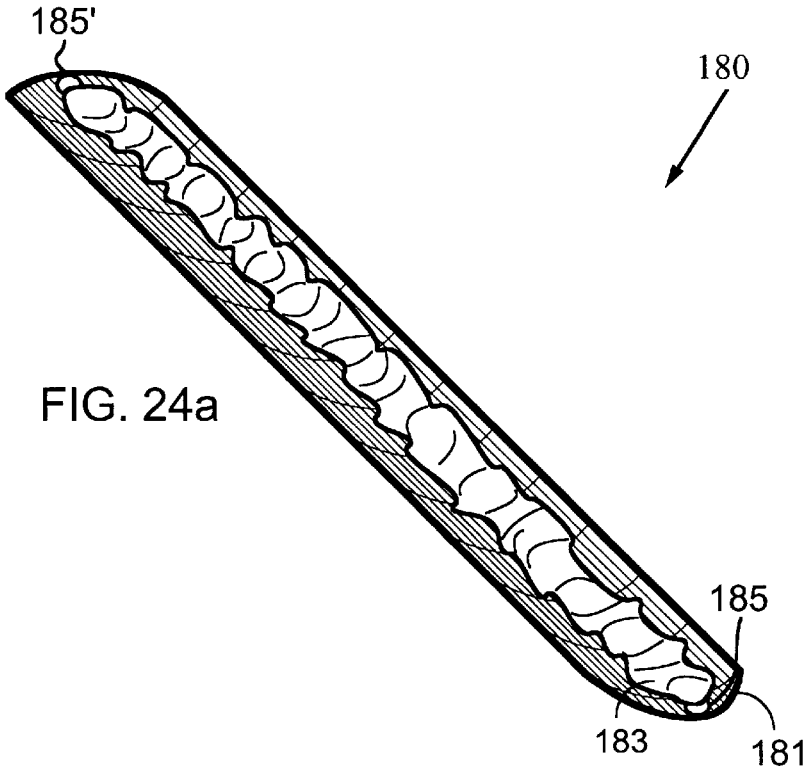
FIG. 24a
FIG. 24b
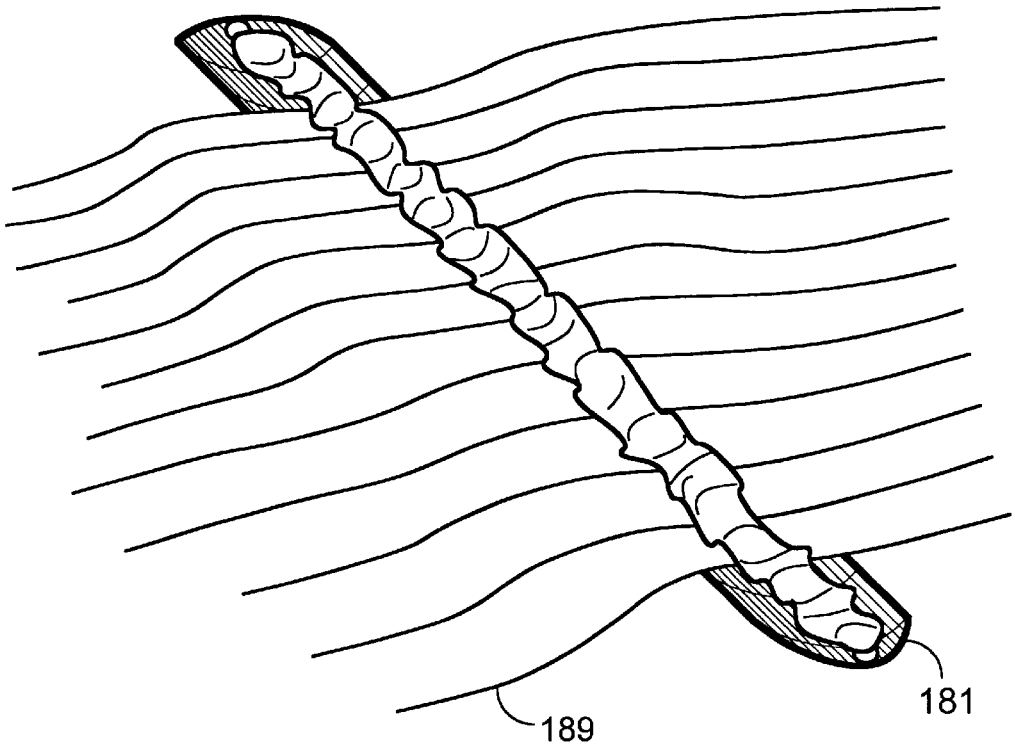

FLIP CLIP HAIR STYLING APPARATUS AND METHODS

RELATED APPLICATION(S)

This application is a continuation in part of the co-pending U.S. patent application Ser. No. 09/172,093 filed Oct. 13, 1998 entitled "Spring Strip A Hair Clip" which is herein incorporated by reference.

FIELD OF THE INVENTION

This invention relates generally to a device and method for holding and styling hair. More particularly, it relates to a device and method for holding and styling hair, which utilizes a self-coiling spring member.

BACKGROUND OF THE INVENTION

There are several devices known in the art for holding hair in styled configurations. Elastic loop devices, for example are used to hold sections of hair or bunches of hair in "pony tail-like" styles. The elastic loop devices typically are unattractive and are very limited to their function. Larger hinged clamping devices, hairpins and the like are used to pinch or sandwich sections of hair and hold the sections in a style. Clamp or pin devices serve essentially the same function as elastic loop devices, namely to hold sections of hair. Headband devices are used to hold hair against the head and to keep hair from falling in front of the users face, but are not generally used to style hair. U.S. Pat. No. 5,833,335 issued to Voughloln, describes a hairstyling device and method, where a device engages a section of hair. The device is then used as a template to manually manipulate the hair into several alternative styles. While the device does allow the hair to be styled in several configurations, it does not itself style the hair and only provides a template on which various styles can be created.

What is needed is a device that can hold sections of hair in a styled configuration that is compact, easy to store and can easily be modified to have several decorative features. Preferably, the device is versatile and can be used to hold sections of hair in many different hairstyles. Also, what is needed is a device that not only, holds sections of hair, but also styles the sections of hair.

SUMMARY OF THE INVENTION

It is a primary object of the present invention to provide a device and method for holding hair in a style configuration that utilizes a self-coiling spring member. The self-coiling spring member has a stable open state that allows the spring member to be positioned against or through sections of hair during styling operations. After positioning the self-coiling spring member against or through sections of hair, the spring member is actuated and coils sections of hair. The self-coiling spring member is actuated to coil by bending a portion of the spring member towards the 45 coiled positioned.

The self-coiling spring members used in the preferred embodiments of the current invention are elongated pieces of carbon steel spring. For most applications the spring members have widths between 0.5 and 3.0 inches and lengths between 4.0 to 12 inches. The spring members are intended to hold sections of hair in position and, therefore, require appropriate spring strengths. For pieces of carbon spring steel, described herein, it has been determined that appropriate spring strengths are exhibited for sections of carbon spring steel that coil by applying a pressure of 2.0 pounds or greater to an inner coiling surface of the spring. The elongated spring members are easily adapted to have decorative features as described below.

In a preferred embodiment of the current invention the device comprises two elongated strips. Sections of hair are sandwiched between the two spring strips with the spring strips in their elongated open state. The spring strips are then actuated to coil concurrently to generate the desired hairstyle. Prior to actuating the spring strips, the sandwiched hair can be manipulated or rolled to facilitate the generation of numerous hairstyles. It is preferred that the two spring strips are attached at one end in order to keep the spring members aligned while used.

In the most preferred embodiment of the current invention the device comprises one elongated spring strip, with an elastic or stretchable section secured near the ends of the spring strip. Sections of hair are sandwiched between the spring strip and the stretchable section with the spring strip in its elongated open state. The spring strip is then actuated to coil to generate the desired hairstyle. As above, prior to actuating the spring strip to coil, the sandwiched hair can be manipulated or rolled to facilitate the generation of numerous hairstyles.

In an another embodiment of the current invention, the device has one spring strip that is detachably connected to an elastic loop member. The elastic loop member is used to wrap around a section of hair, such as a ponytail, and the spring member wraps around the elastic loop member, thus helping to hold the section of hair in position while adding a decorative feature to the hairstyle. The spring strip is modified with a variety of decorative and functional features including cloth sleeve that can be removed and changed to suit the user's attire.

In yet another embodiment of the current invention a body section connects several spring strips to each other. The spring strips are preferably positioned and attached to the body section such that they coil in the same directions acting as closing fingers or collectively as "a claw" to wrap around a section of hair. For example, the device is positioned near or against a bunched section of hair and with the strips in their elongated open state. Each strip is then actuated to coil, clamping the bunched section of hair in a "claw-like fashion". This embodiment is particularly useful for holding larger bunched sections of hair.

In still another embodiment, long thin spring strips are configured to be easily pushed through bunched sections of hair like a hair stick. The spring strips are then actuated to coil, as described above, to wrap around portions of the bunched section of hair and holding the hair in a styled configuration.

DESCRIPTION OF THE FIGURES

FIG. 1 is a perspective view of a spring strip in an open, high-energy state, according to the present invention.

FIG. 2 is a perspective view of a spring strip in a partly coiled, intermediate energy state, according to the present invention.

FIG. 3 is a perspective view of a spring strip in a closed, low energy state, according to the present invention.

FIG. 5 is a perspective view of a spring strip in an open, high-energy state, according to the present invention.

FIG. 6 is a perspective view of a spring strip in a partly coiled, intermediate energy state, according to the present invention.

FIG. 7 is a perspective view of a spring strip in a closed, double-coiled state, according to the present invention.

FIGS. 18*a–c* illustrate successive steps of creating two "ponytail" hairstyles, according to the present invention.

FIGS. 22*a–c* illustrate successive steps of creating a "French buttons" hairstyle, according to the present invention.

FIGS. 23*a–c* illustrate successive steps of creating a "rose" hairstyle, according to the present invention.

FIGS. 24*a–b* illustrates a spring strip with an elastic section attached near the ends of the spring strip and a section of hair sandwiched between the spring strip and elastic section.

FIG. 26 illustrates a hair styling device with hair attachments connected to a spring strip.

DETAILED DESCRIPTION OF PREFERRED EMBODIMENTS

The current invention utilizes self-coiling springs to hold sections of hair and/or style sections of hair. The method and device described, herein, preferably uses spring strips, described in detail below. However, it will become clear that any elongated self-coiling member or self-coiling member that exhibit stable extended open states configured to coil around sections of hair are within the scope of the current invention. For example, self-coiling wires, plastic strips and mechanical strips that have stable extended open sates may also be used.

Energetic Properties:

A hair styling article according to a preferred embodiment of the present invention comprises a strip 10 of material having a continuum of mechanical energy states. As shown in FIG. 1, an "open" state of the strip is a stable state of equilibrium having high energy. In the open state the strip 10 is extended linearly in the longitudinal direction and has a slight curvature around the longitudinal axis. A "closed" or "coiled" state of the strip 10, shown in FIG. 3 is a stable state of equilibrium having low energy. In the closed state the strip is coiled or rolled up upon itself. Between these open and closed states is a continuum of unstable non-equilibrium states, most of which have energies intermediate between the energies of the open and closed states. A strip 10 in one such partly coiled state is shown in FIG. 2. In these intermediate energy states the strip is partly coiled and spontaneously releases its energy and moves toward more coiled states.

Figure 4:
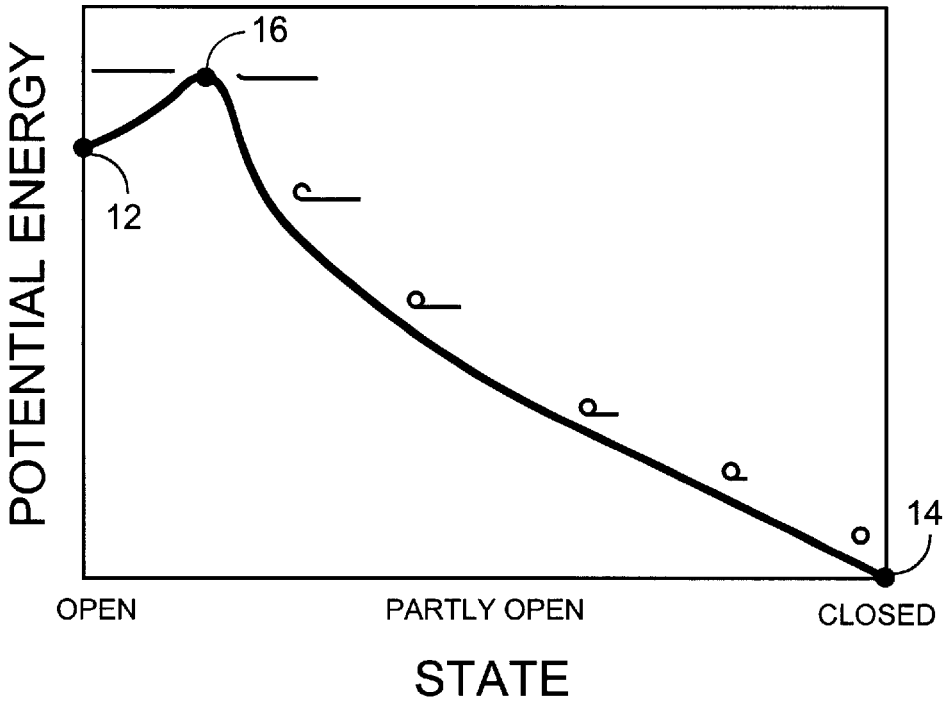
FIG. 4 is a graph of the spring strip energy vs. spring strip state, according to the present invention.

FIG. 4 is a graph illustrating the relationship between the mechanical potential energy of the strip 10 and its state. At the left side of the graph is the open state 12 of the strip, which has a high energy, while at the right side of the graph is the closed state 14 of the strip, which has a low energy. Near the open state is a region of unstable states of energy slightly higher than that of the open state. Consequently, the open strip remains in the open state until it is pushed out of this equilibrium state and past the intermediate state characterized by the maximal amount of energy 16. The strip then spontaneously coils up and releases its energy until it arrives in the closed state 14 of lowest energy or is arrested in an intermediate state by an external restraining force. A closed or partly closed strip may be opened by forcibly uncoiling it. If the strip is pushed open past the highest energy state 16, then it spontaneously snaps into the open state of equilibrium.

Figure 8:
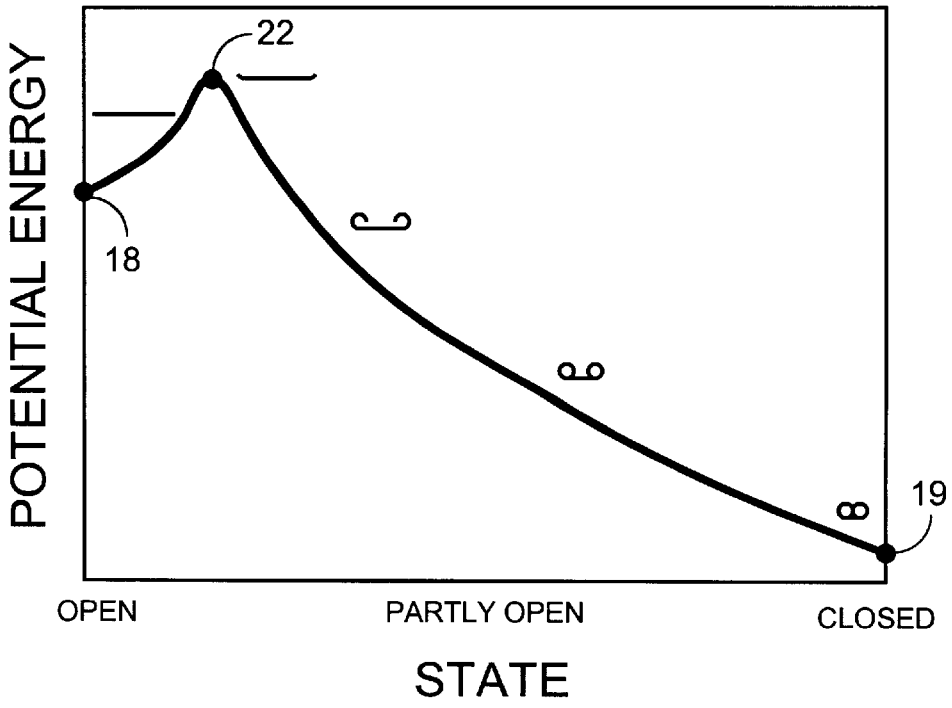
FIG. 8 is a graph of the spring strip energy vs. spring strip state, according to the present invention.

A strip 10 according to the present invention may coil up from one end to the other, as illustrated above in FIGS. 1, 2 and 3. Alternatively, the strip may coil up from both ends simultaneously, as shown in FIGS. 5, 6, and 7. FIG. 5 shows the strip in the open state, FIG. 6 shows the strip partly coiled from both ends, and FIG. 7 shows the strip in the closed state, or "double coiled" state. A graph illustrating the potential energy vs. state for a strip experiencing double coiling is shown in FIG. 8. The open state 18 is a high-energy equilibrium state, just as before. The closed state 19 is again a low energy equilibrium state, but in this case its energy is slightly higher than the closed state 14 of the single-coiled strip (FIG. 4). This difference in energy is due to the fact that a portion 22 of the double coiled strip remains straight in the closed position. Thus, a portion of the potential energy of the double coiled strip remains unreleased. The highest energy state 22, like state 16 (FIG. 4), is the peak of an energy barrier that separates the open and closed states from each other. To open a closed strip, or close an open strip, the strip must be given sufficient activation energy to push the strip over this peak. Once pushed over the peak, the strip relaxes into the open or closed state.

Figure 9A:
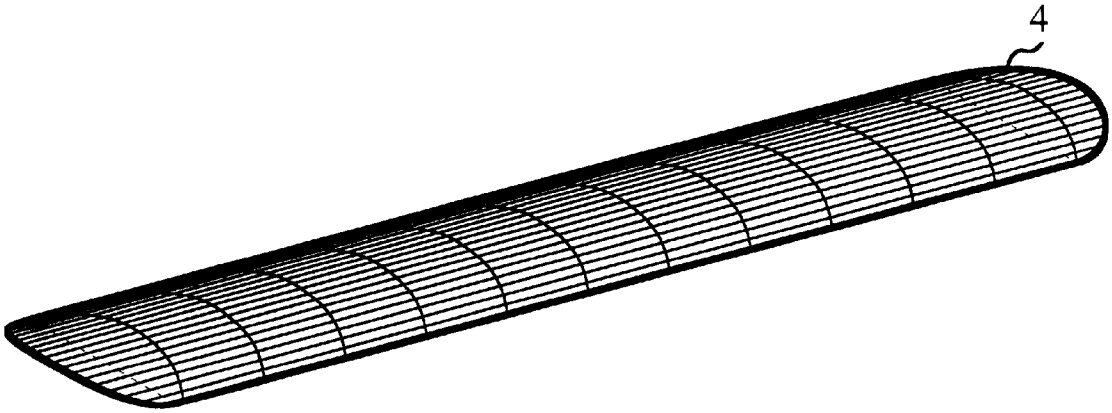
FIGS. 9*a–b* illustrate the force applied to the inner coiling surface of spring strip to activate the spring strip to coil.
Figure 9B:
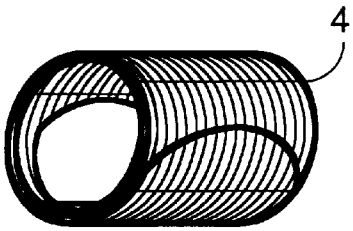

Method of Measuring Activation Forces and Spring Strengths of Spring Strips:

The spring strips described above are activated to go from the elongated open state to the closed coiled state in several ways. Bending an end or both ends of a strip inward towards the closed coiling position will cause the strip to self-coil to the closed state. Alternatively, sufficient point force applied to the convex inner coiling surface of the spring coil will cause the spring strip to coil. The activation force required to coil the spring strip is generally proportional to the spring strength. FIG. 9*a* illustrates the method used to measure the force required to coil the spring strips used in the preferred embodiments of the current invention. Briefly, activation force measurements were performed with a standard Wagner Gauge (not shown) used in the industry to measure activation forces and physical properties of materials. The Wagner Gauge has dowel pin with a tip area on the order of 0.25 $(\text{inches})^2$. The dowel pin is connected to a force sensor that measures that force against the tip as the tip is lowered against the inner coiling surface of the spring strip. In these measurements, the strip 4 was placed on a flat rigid surface and the dowel pin was lowered against the inner coiling surface of the spring strip until the strip coiled (as shown in FIG. 9*b*) and a force measurement was taken. Activation force measurements were performed on several of the spring strips used in the preferred embodiments of the current invention. It was determined that the spring strips should preferably coil with a force equal to or greater than 2 lb. in order to have sufficient spring strength to hold portions of hair firmly in styled configurations described herein.

Material Composition of Strips:

Strips possessing the essential defining properties described above may be composed of any of various materials such as metal, plastic, or other suitable natural or synthetic compound or ferrous or non-ferrous laminate. In the preferred embodiment of the present invention, the strip is composed of carbon spring steel—a metal alloy treated by a well-known process of coiling, winding, and forming that results in a strip of steel having a slight arc centered around its longitudinal axis, and exhibiting the energetic properties described above. The process can be adapted to strips of various sizes and thicknesses, and can also be adapted to create strips having various properties such as different coiling radii and different coiling forces. In an alternative embodiment, the spring strip is composed of a stiff plastic material. Based on the guidance provided in the present description, those skilled in the art of materials engineering can select specific materials and processes to manufacture various types of spring strips appropriate for use in various embodiments of the hair styling article of the present invention.

Physical Dimensions of Strips:

A hair styling article according to a preferred embodiment of the invention comprises a spring strip 10 measuring approximately 1 inch by 10 inches. As will be evident from the description below, however, a wide range of dimensions are possible and useful. For example, one useful embodiment of the invention employs a small spring strip measuring approximately ½ inch by 2 inches, while another embodiment uses a large spring strip measuring 3 inches by 24 inches. In other embodiments of the invention the hair styling device and method utilizes sections of spring strips or fingers of spring strips that coil around sections of hair. The sizes of the strips or sections of strips used, as well as their other properties, depend on the type of hair that is being styled, as well as on the type of the style. Accordingly, a wide variety of physical dimensions and shapes of the strips are considered within the scope of the present invention.

Figure 10:
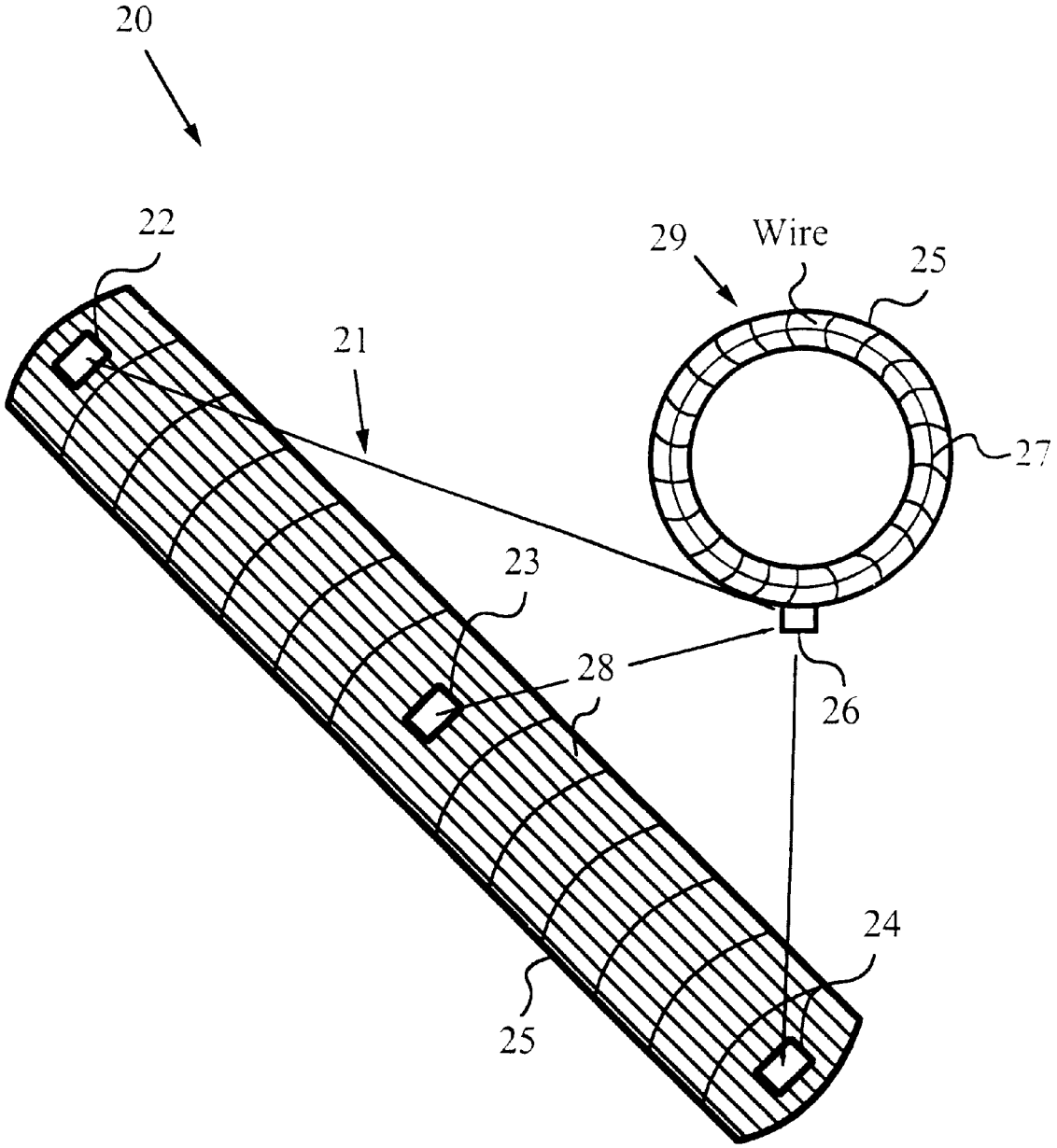
FIG. 10 is a perspective view of a spring strip in an extended open state and an elastic loop member used in conjunction with a spring strip.

FIG. 10 illustrates one embodiment of the current invention. The hair styling system 20 includes a strip 21 and an expandable loop member 29. The strip 21, preferably has at least one fastening element 22 attached near an end of the inner coiling surface 28 of the strip 21. On a portion of the expandable loop member 29 there is an attached complimentary fastening element 26 that is capable of being mated with the fastening element 22 in order to detachably secure the strip 21 to the loop 29. The strip 21 may have a plurality of fastening elements 22, 23 and 24, which are located at various positions along the inner coiling surface 28 of the strip 21. A fastening element may also be attached to the outer coiling surface 25 of the strip 21, as long as the fastening mechanism of choice allows the loop member to be positioned within strip when the strip is in a coiled configuration. The fastening elements are any fastening/connecting elements known in the art, but are preferably hook type fabric fasteners or two part snaps.

Again referring to FIG. 10 the expandable loop member 29 is made of a stretchable material such as elastic fabric, or rubber. Alternatively, the loop member 29 has a stretchable material 27 that is surrounded by, and preferably enclosed by, an expandable jacket 25. The expandable jacket 25 may be cloth that has sufficient material to allow the loop to expand, wherein the jacket material becomes bunched when the expandable element is in a contracted state, or alternatively, the jacket 25 is an expandable material that expands concurrently with the expandable element 27.

Figure 11A:
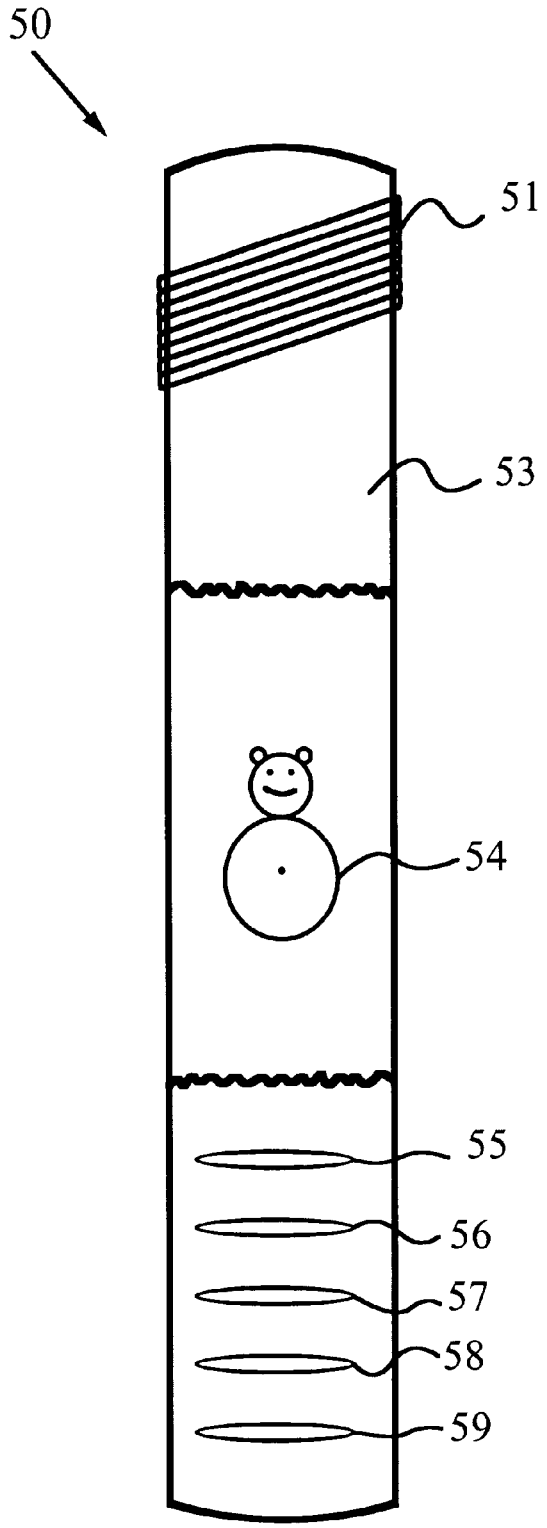
FIGS. 11*a–b* illustrate several decorative features that are incorporated into spring strips used in the current invention.
Figure 11B:
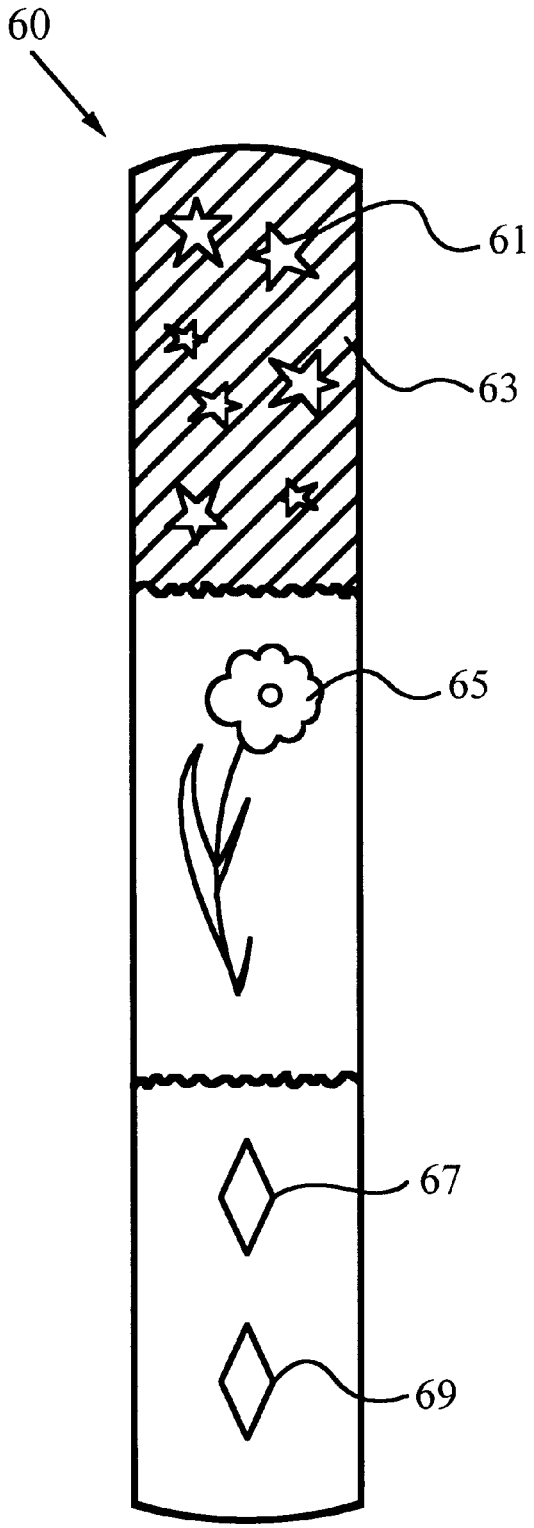

FIGS. 11*a–b* will be used to illustrate the many ways that the appearance of the coiling strip may be altered to provide cosmetic enhancement and/or functional topographical features. The surfaces 53 and 63 of the strips 50 and 60, respectively, can be coated with a soft plastic that is colored, clear, smooth, textured or any combination thereof. The coating may be composed of any of various different materials such as plastic resin materials, polyesters, synthetic rubber, kraton, foam or other synthetic or natural material. A coating may be applied to a strip using appropriate techniques. For example, an injection molding process may be used to apply a plastic resin or polyester coating to the strip. A compression molding process may be used to apply a synthetic rubber coating, and a room temperature curing process may be used to apply a foam coating. The strip may also be rubber coated with a vulcanizing process, or vinyl coated by a dipping process. The coating may also contain embedded decorative items such as sparkles.

Now referring to FIG. 11*a*, the coiling strip is decorated with a string 51 that is wrapped around a portion of the strip 50 and glued to its surface 53. The surface is also decorated by attaching a figurine 54 to the surface 53. The figurine may be permanently attached or made to be detachable. A portion of the surface 53 may also be textured with raised portions 55–59 to help hold the strap in a preferred orientation while being used to style a section of hair.

Now referring to FIG. 11*b*, the surface 63 of the strip 60 is decorated by imbedding small decorative items, such as sparkling stars 61, or foil chips (not shown) in a partial transparent coating. Alternatively, the surface 63 is painted. The surface 63 can be painted with simple colors or more complex scenery such as flowers, landscapes and the like. Also, the surface 63 is patterned with punch-out shapes, wherein the shapes go through the strip. Preferably, punch-out shapes are relatively small so that the coiling characteristics of the strip are not compromised.

All spring strips used in particular embodiments of the current invention may be decorated in the manner described above. Further will be appreciated that the coating, wrapping, painting or decorating of a strip is not a necessary component of the present invention. Further, a strip may be manufactured to have inherent topographical surface features, produced by any known techniques such as stamping, embossing, injection molding and any secondary operations.

Figure 12:
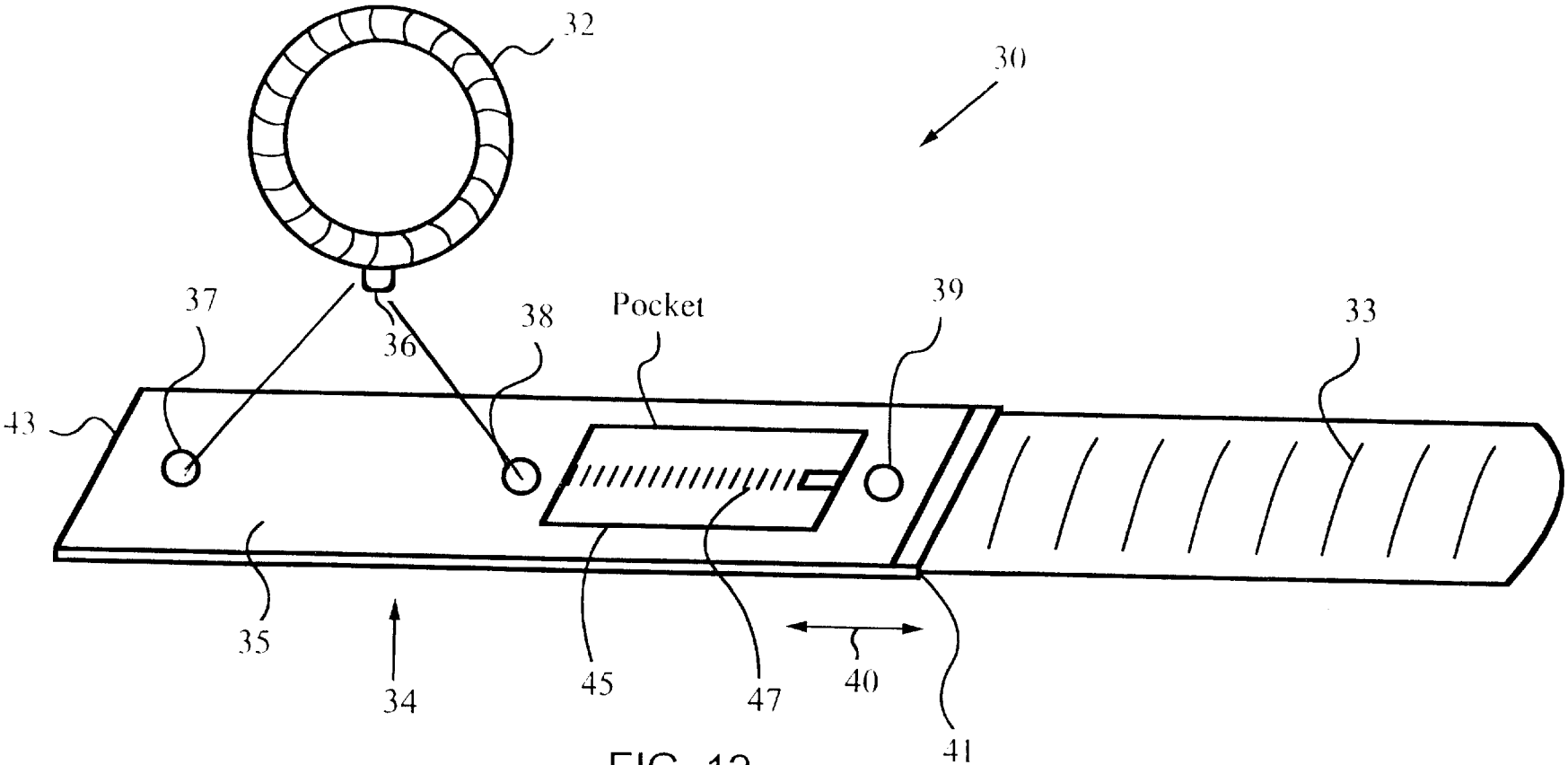
FIG. 12 shows a spring strip with a sleeve and attachments for attaching an elastic loop member according to one embodiment of the current invention.

Using the Spring Strip Hair Clip with an Expandable Loop:

Now referring to FIG. 12, the hair styling system 30 has a strip 33, an expandable loop member 32 (as described for FIG. 10) and a sleeve 34. In this preferred embodiment, the sleeve 34 has a closed end 43 and an open end 41 from which the strip 33 can be slidably moved in a direction 40. In this way the strip 33 can be removed and a new sleeve (not shown) with a different color or design can be readily used to alter the appearance of the hair styling system 30. Alternatively, the strip 33 may be permanently sealed within the sleeve 34.

Again referring to FIG. 12, attached to the inner coiling sleeve surface 35 there is at least one fastening element 37 (similar to that described for FIG. 5) and complimentary fastening element 36 attached to a portion of the expandable loop member 32 for removably attaching the expandable loop member 32 to the inner coiling sleeve surface 35. A fastening element is preferably attached to an end portion of the sleeve as indicated by 37 and 39, but may also be located at any position on the inner coiling sleeve surface 35. Alternatively, there may be a plurality of fasting elements as shown by 37, 38 and 39.

The sleeve 34 is preferably a cloth material. The sleeve 34 is fitted or tailored to the shape of the strip 33. Alternatively, the sleeve 34 is made of other malleable synthetic or natural materials. In a particular embodiment of the current invention the sleeve 34 is made from a cloth material and has a pocket unit 45 attached to to the surface 35 of the sleeve 34 for storing small items. The pocket unit 45 may be configured to operate like any of the pocket compartments know in the art. For example, an inner potion of the pocket unit 45 is accessible through a small zipper 47 or a flap (not shown).

Figure 13A:
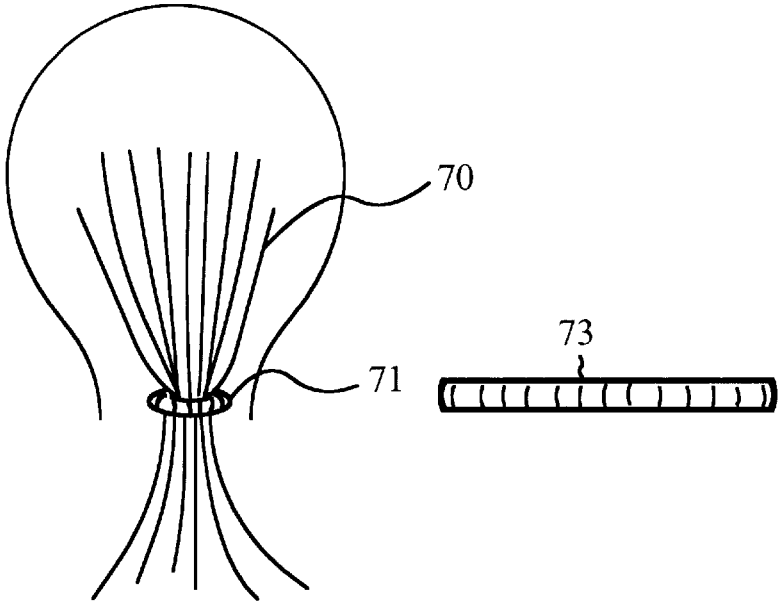
FIGS. 13*a–c* illustrates a method of implementation for the hair styling system comprising a spring strap and an elastic loop member according to the current invention.
Figure 13B:
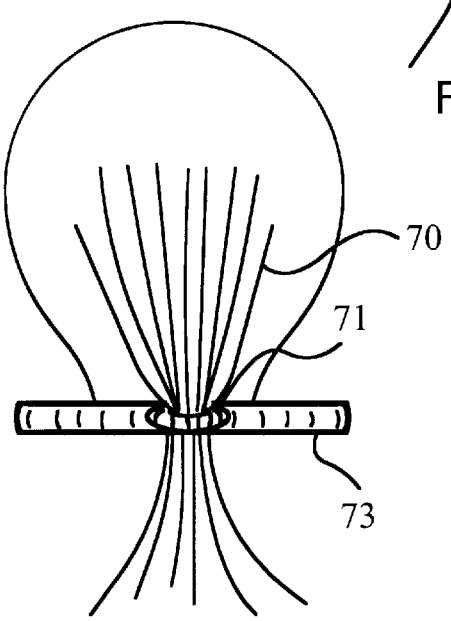
Figure 13C:
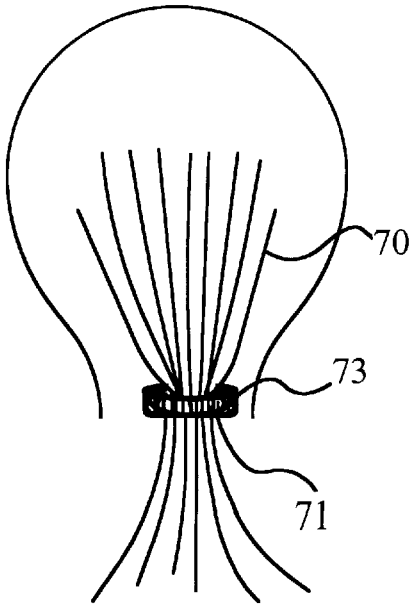

The use of the spring-strip and loop, described above will now be illustrated with the following Figures. Referring to FIG. 13*a*, a section of hair 70 is bunched and placed through the expandable loop member 71. The strip 73 is then positioned with the inner coiling surface of the strip near or against a portion of the loop member 71, as shown in FIG. 13*b*. A portion of the strip 73 is bent inward toward the inner coiling surface of the strip, thus allowing the strip to coil to a low energy coiled shape, whereby the strip is coiled or wrapped around a portion of loop member 71 and a section of hair in order to hold the hair 70 in a ponytail configuration, as shown in FIG. 13*c*.

Figure 14A:
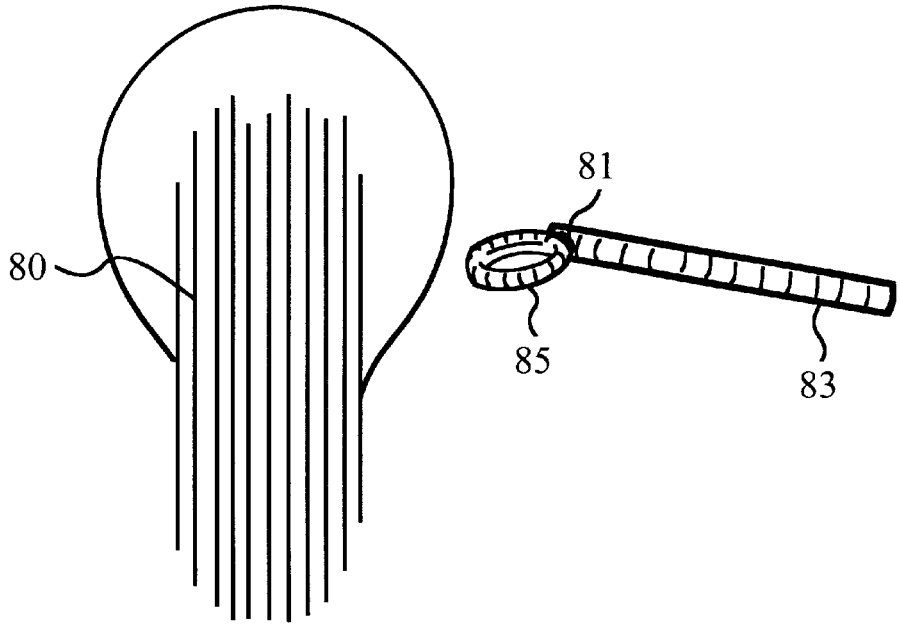
FIGS. 14*a–c* illustrates an alternative method of implementation for the hair styling system comprising a spring strap and an elastic loop member according to the current invention.
Figure 14C:
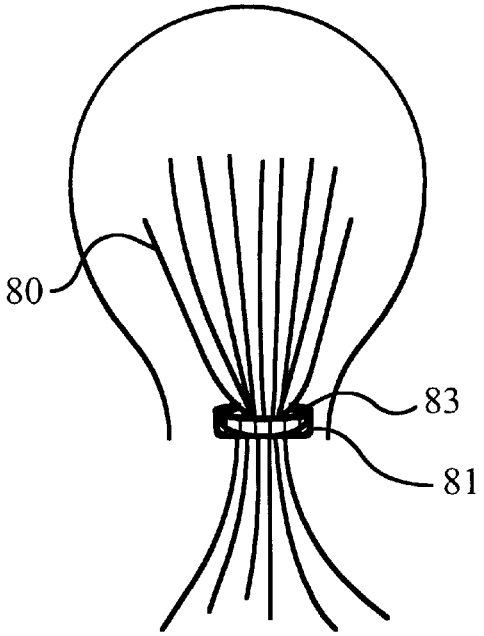
Figure 14B:
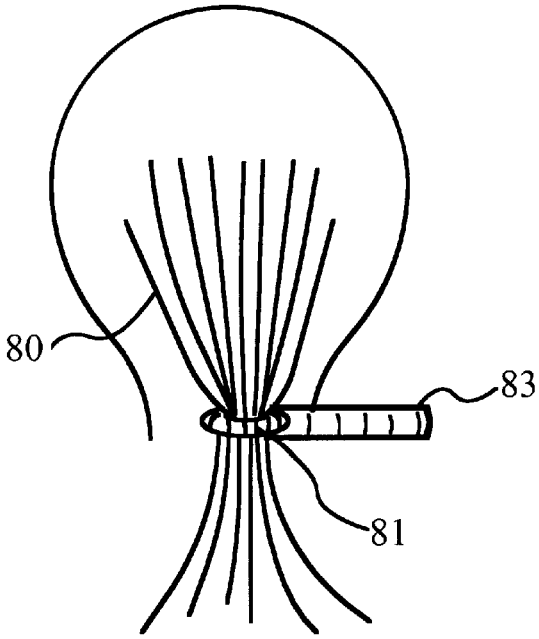

FIGS. 14*a–c* show the use of the implementation of a spring strip and expandable loop of the current invention, wherein the expandable loop member 81 is attached to the strip 83 by a fastening mechanism 85 previously described. Again, a portion of hair 80 is bunched and positioned through the expandable loop member 83, as shown in FIG. 14*b*. The strip 83 is then bent inward toward the inner coil surface of the strip and the strip 83 wraps around a section of the expandable loop 81 and a portion of the hair in order to hold the hair 80 in a ponytail configuration, as shown in FIG. 14*c*.

Figure 15A:
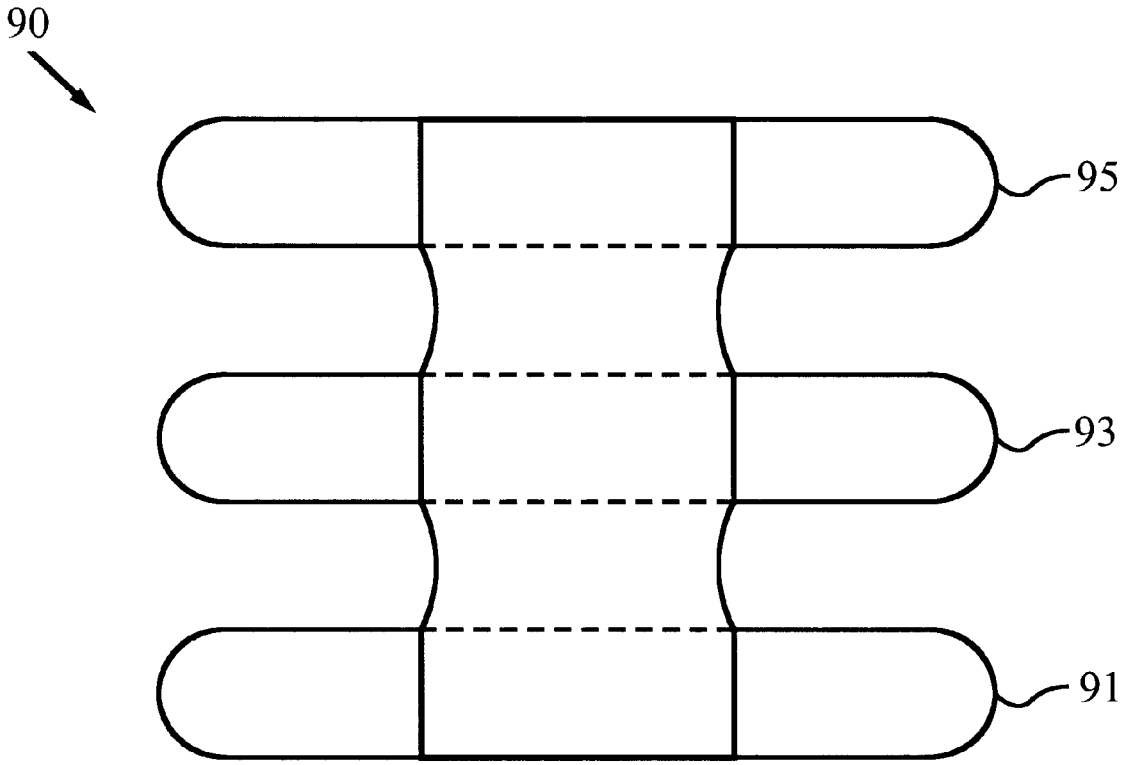
FIGS. 15*a–b* illustrates a spring member configured with a plurality of coiling fingers for holding a section of hair in a styled configuration and an implementation of the device.
Figure 15B:
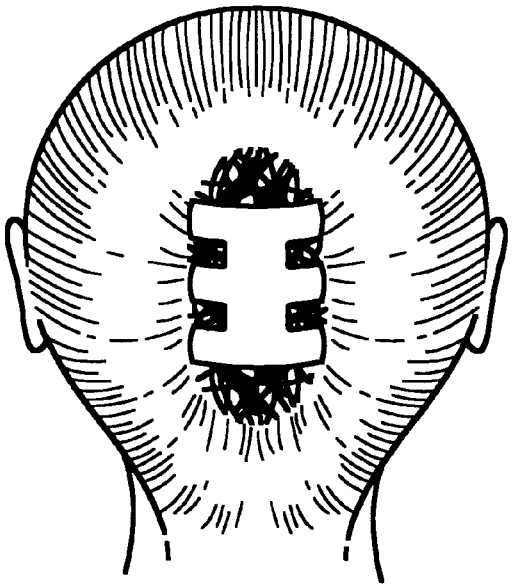

Configuration and Use of a Plurality of Connected Spring Strips:

Referring to FIG. 15*a*, in an alternative embodiment of the current invention several spring strips 91, 93 and 95 are attached together by a body member 94. In the preferred configuration all the spring strips 91, 93 and 95 are substantially parallel with their inner coiling surfaces and outer coiling surfaces facing the same direction. The device 90 is used to coiled around a large section or grouping of hair and to hold the hair in place, such as shown in FIG. 15*b*.

Figure 16:
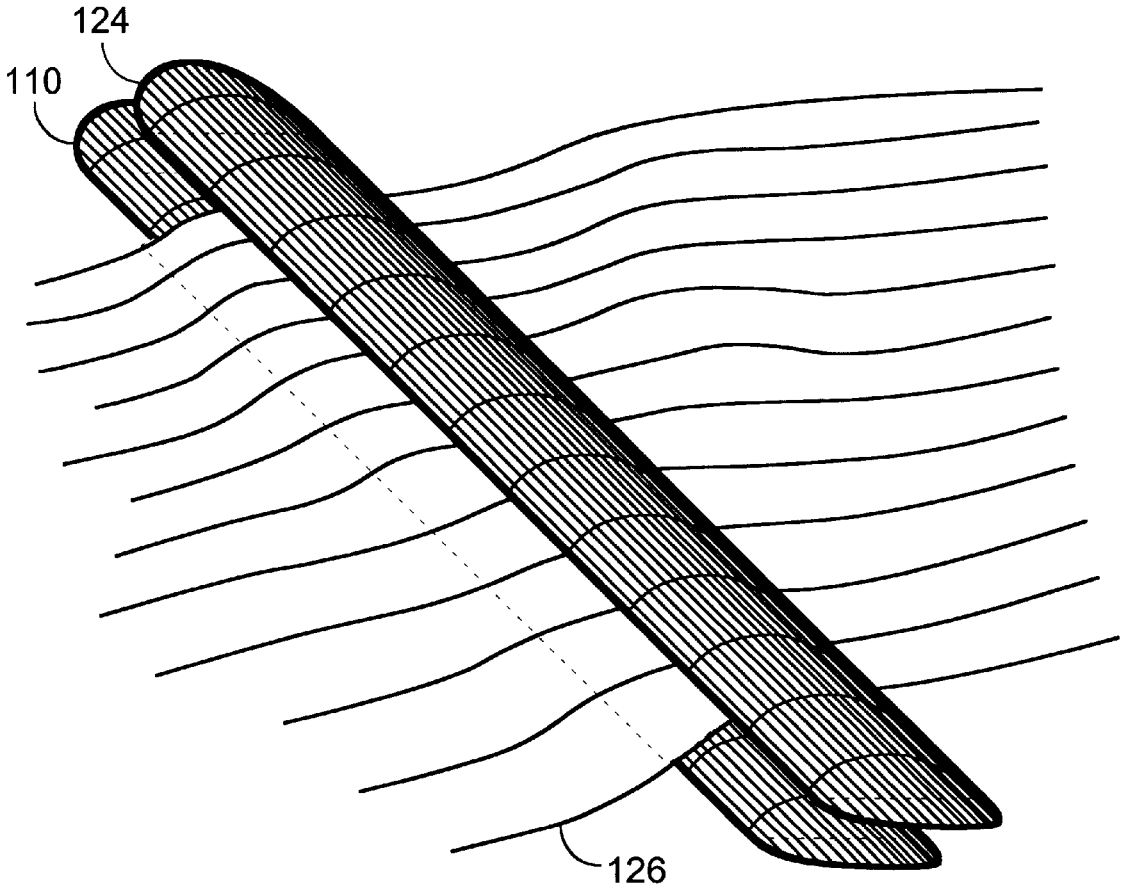
FIG. 16 is a perspective view of hair positioned between a pair of strips in an open state, according to the present invention.
Figure 17A:
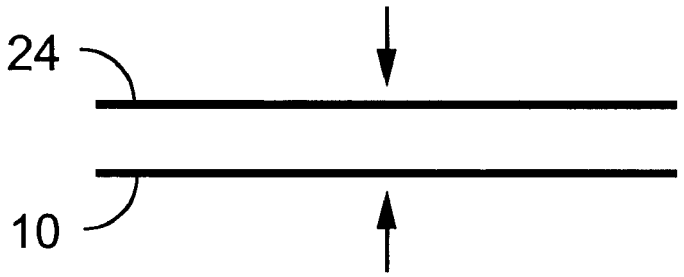
FIGS. 17*a–d* illustrate successive steps during double coiling of a pair of strips, according to the present invention.
Figure 17B:
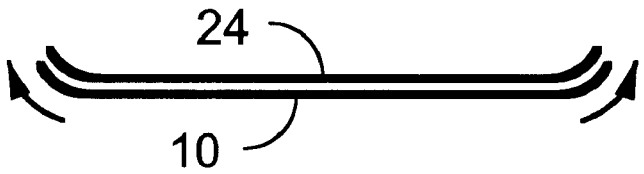
Figure 17C:
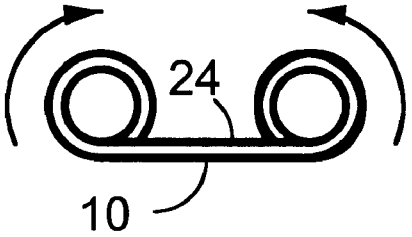
Figure 17D:
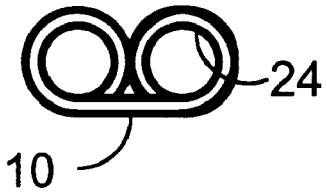

Pairs of Strips Working Together:

In general, the article of the invention comprises at least one spring strip 110, and a second strip of material 124 for securing the hair 126 against the spring strip 110 while it is in the open state, as shown in FIG. 16. In the preferred embodiment of the invention, the second strip 124 is a second spring strip. In this particularly advantageous embodiment of the invention, the two strips are of equal, or nearly equal size, and one naturally nests within the other when they are aligned. As shown in FIGS. 17*a–d*, when the two strips are placed together (FIG. 17*a*) and 'snapped' out of their open positions (FIG. 17*b*), they coil up together (FIG. 17*c*) to their double coiled, closed positions (FIG. 17*d*). In this mutually coiled state, the two spring strips are tightly secured against each other. This synergistic property of two strips allows them to securely hold hair 126 that was placed between them prior to coiling.

In addition to simply holding the hair, the coiling action of the strips also serves to dynamically style the hair at the same time. Two examples of this highly advantageous property of the present invention are illustrated in FIGS. 18*a–c*. In FIG. 18*a* is shown the placement of the hair 126 between the two open strips 110 and 124. When the strips are snapped out of their open states, they release their potential energy and coil up, coiling the hair with them. If strips 110 and 124 are oriented so that they coil away from the head, the style shown in FIG. 18*b* results. This hairstyle is similar to a ponytail, but provides a more styled look. Alternatively, if strips 110 and 124 are oriented so that they coil toward the head rather than away from the head, the hairstyle shown in FIG. 11*c* results. For persons with thin hair, this style has the advantage that it provides the appearance of a fuller ponytail with more hair volume.

It will be appreciated that two spring strips are not necessary to practice the present invention. Another embodiment of the invention comprises one spring strip 110 together with a non-springed strip 124 of flexible material to hold the hair against the spring strip. When the spring strip 110 coils into the closed position, the hair 126 is held and styled just as in the case of two springed strips. The flexible material may be composed of various materials such as a natural or synthetic fabric, a plastic, rubber, or elastic chord, a metal, or some combination thereof. It will be understood that these materials are simply examples and that any material is suitable, provided that it both serves to hold the hair against the open spring strip and is capable of coiling up with the spring strip. With this in mind, it will be appreciated that many of the features described herein in relation to the second spring strip 124 pertain equally to any non-springed strip.

Figure 19A:
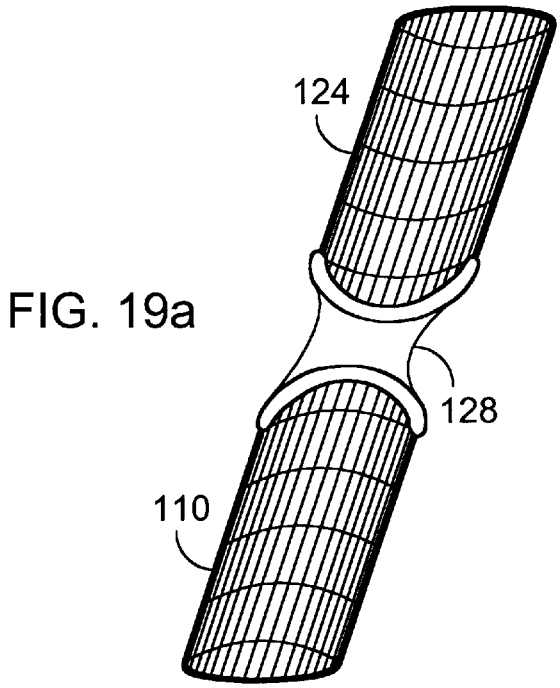
FIGS. 19*a–b* are perspective views of a pair of attached strips, according to the present invention.
Figure 19B:
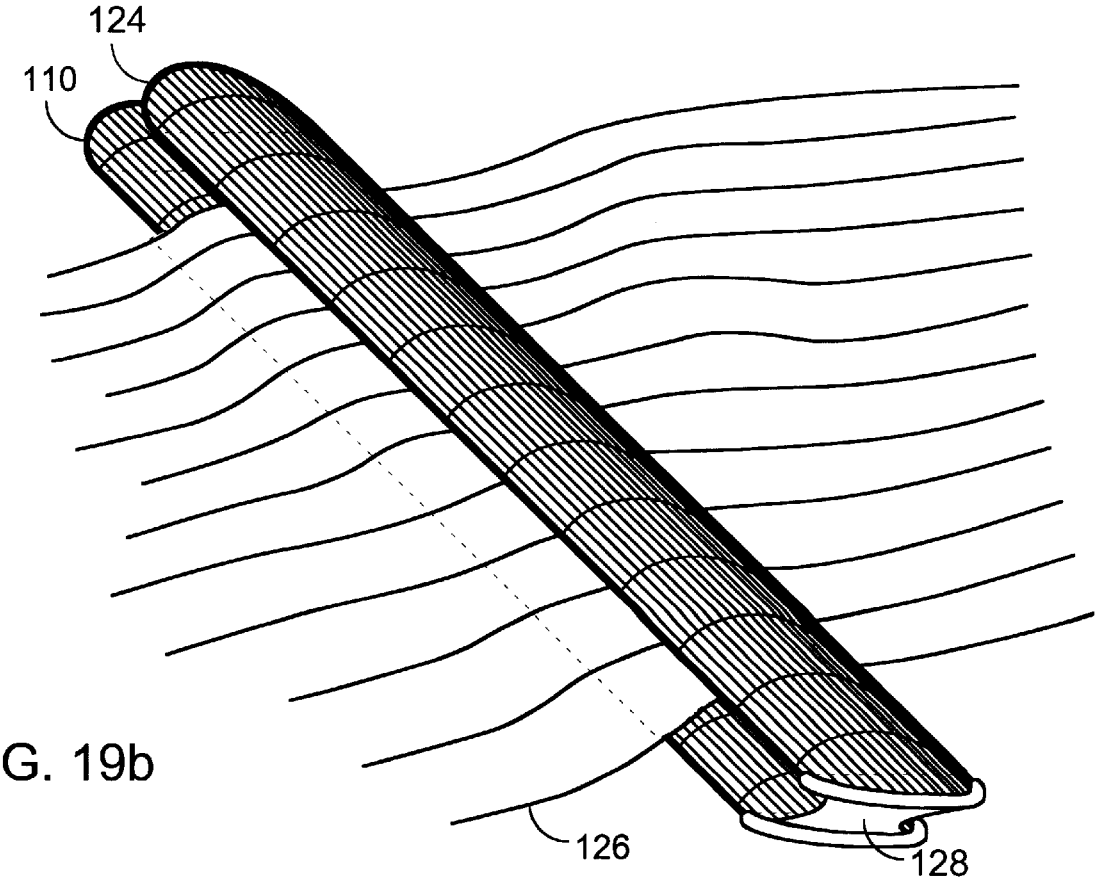

Attachment of Two Strips:

In a preferred embodiment of the invention, the two spring strips 110 and 124 are flexibly attached to each other by an attachment member 128, as shown in FIGS. 19*a* and 19*b*. The attachment member 128 flexibly joins an end of the first spring strip to an end of the second spring strip. The attachment member serves to prevent the two strips from becoming separated while the strips are open and not in use, as shown in FIG. 19*a*. It also assists in retaining the open strips in alignment when hair 126 being placed and positioned between them prior to coiling, as shown in FIG. 19*b*. The attachment member is flexible either by virtue of being composed of a flexible material, or by virtue of being a type of hinge or similar element. In the preferred embodiment, the attachment member is a flexible material such as rubber, soft plastic, polyester, krayton, or other similar material.

It will be appreciated that the attachment member is not necessary to practice the present invention. Indeed, the invention in its simplest manifestation comprises two unattached strips that are manually aligned during use, as shown in FIG. 16. This embodiment of the invention allows either of the strips to be easily exchanged for another, so that a given pair of strips need not always be used together.

The strips may be easily used in two distinct configurations: one with the first strip 110 on the inside when coiled, the other with the first strip 110 on the outside when coiled. Although these configurations are functionally identical in the case of two spring strips, if the strips are differently ornamented, these two configurations provide more variety of appearance to the user. It should be noted that such configurational changes are not limited to non-attached strips since attachment members that allow 360-degree changes in relative orientation of the strips permit such changes of configuration.

Using the Spring Strip Hair Clip:

Embodiments of the present invention may be used to create a wide variety of hairstyles. As already discussed above in relation to FIGS. 18*a–c*, an embodiment of the present invention may be used to create the two different hair styles shown in FIGS. 18*b* and 18*c*. The method of styling the hair in these cases includes placing the hair 126 between strips 110 and 124 as shown in FIG. 18*a*, then releasing the potential energy of the strips so that they form a double coil (FIG. 7). A different style will be created depending on whether the strips have been oriented so that they coil toward or away from the head. Preferably, when the hair is placed between the strips as shown in FIG. 18*a*, it is evenly distributed across the length of the strips. Generally, if the hair is thicker or if a larger portion of the total amount of hair is to be styled, a larger pair of strips and/or stronger spring force is preferred. For thinner hair or for styling small portions of hair, smaller strips and/or weaker spring force is preferred. For the strongest spring force, spring strips made of spring steel are preferred.

The great versatility of the present invention will now be illustrated through the following examples of easy hairstyles, which may be created using embodiments of the present invention. It will be appreciated that these examples are just a few of the many possible hairstyles that may be created using the hair styling article of the present invention.

Figure 20A:
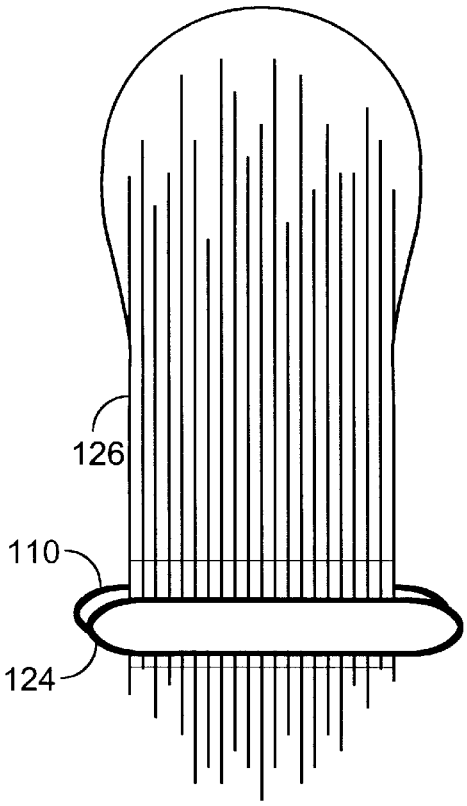
FIGS. 20*a–c* illustrate successive steps of creating a "bun" hairstyle, according to the present invention.
Figure 20B:
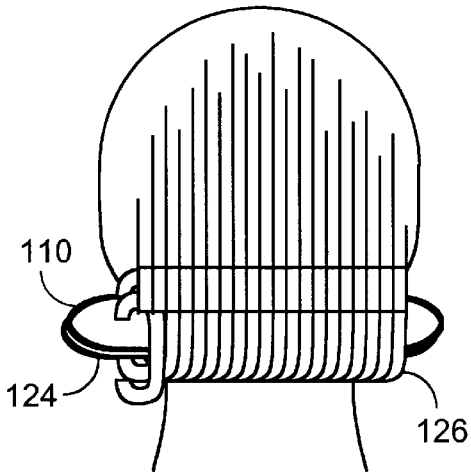
Figure 20C:
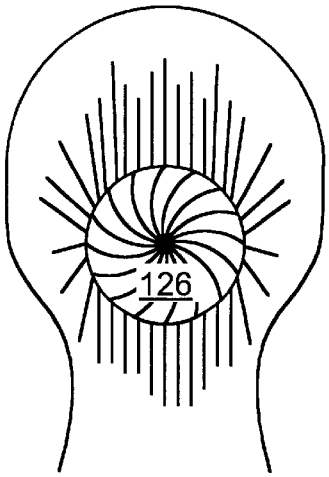

FIGS. 20*a–c* illustrate how a hair bun may be made. First, the hair 126 is placed between two strips 110 and 124, as shown in FIG. 20*a*. Instead of placing the strips near the middle of the strands of hair, as is done in FIG. 18*a*, the strips in this case are positioned near the ends of the strands of hair. The length of hair is then rolled around the strips by turning the strips around their longitudinal axes toward the body. The result of this rolling is shown in FIG. 20*b*. The strips are then released from their open state. As they coil into their closed state (FIG. 3), the hair 126 is wrapped into a bun, as shown in FIG. 20*c*.

Figure 21A:
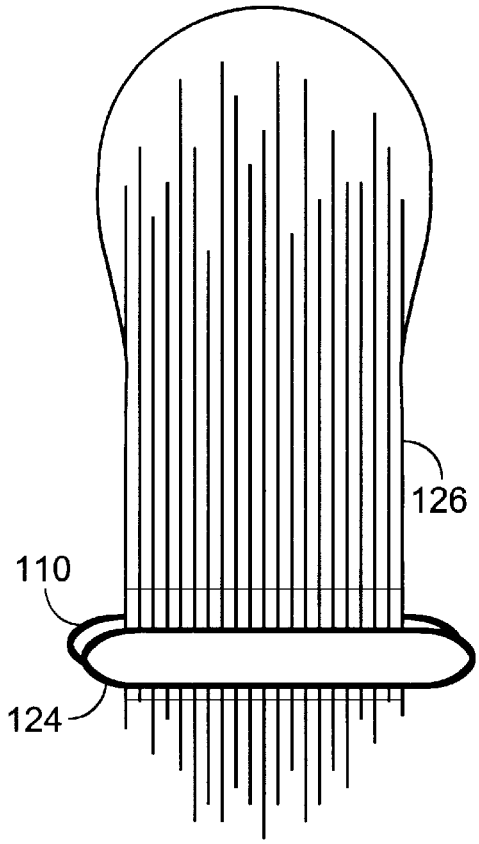
FIGS. 21*a–c* illustrate successive steps of creating an up-do hairstyle, according to the present invention.
Figure 21B:
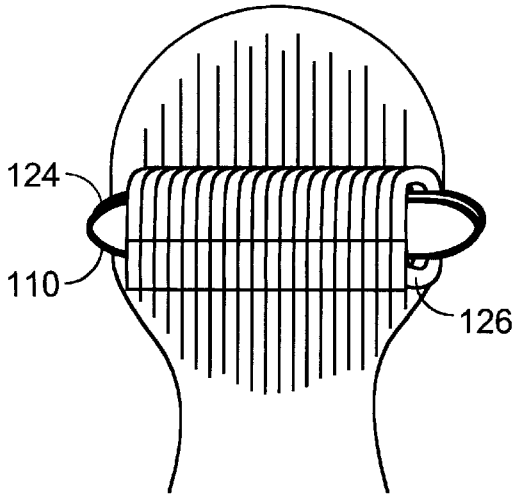
Figure 21C:
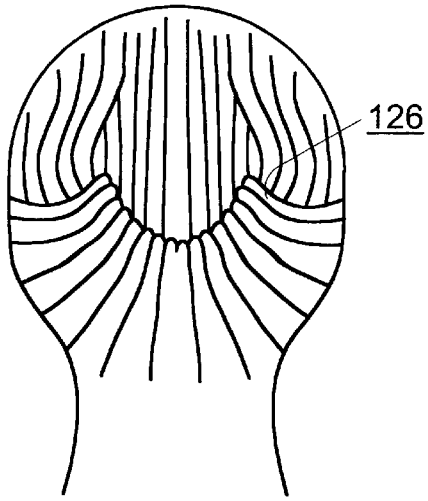

FIGS. 21*a–c* illustrate the creation of another hairstyle. As with the bun just described above in relation to FIGS. 20*a–c*, the hair 126 is positioned between the two strips 110 and 124 near the ends of the strands of hair, as shown in FIG. 21*a*. The hair is then rolled around the pair of strips by turning the strips around their longitudinal axes away from the body. The result is shown in FIG. 21*b*. The strips are then released from their open state and allowed to partly coil. The ends of the strips are tucked into the hair on the back of the head, rather than allowing the ends to coil completely, resulting in the style as shown in FIG. 21*c*.

FIGS. 22*a–c* illustrate a style created using several smaller pairs of strips. A top layer 137 of hair is placed between a first pair 138 of smaller strips, as shown in FIG. 22*a*. The hair is then rolled around the strips, which are then released to their closed states to create a small bun 140, as shown in FIG. 22*b*. A second layer 142 of hair is then placed between a second pair 144 of smaller strips, and a second bun 146 is made in a similar manner. The process is then repeated for successive layers of hair, creating a series of small buns, as shown in FIG. 22*c*.

FIGS. 23*a–c* illustrate a style created using a small pair of strips and a regular sized pair of strips. First, a top layer of hair 148 is placed between a first pair 150 of smaller strips, as shown in FIG. 23*a*. Just as in the previous style, the hair is then rolled and the strips are closed to create a small bun 152, as shown in FIG. 23*b*. The remaining hair 154 is then placed between a pair 156 of regular sized strips and rolled up around the strips as if creating a second bun. When the regular sized strips are released from their open state, however, they are guided to coil the rolled hair 154 around the smaller bun 152, resulting in the hairstyle shown in FIG. 23*c*.

As the above examples illustrate, the article of the present invention may be used to create a wide variety of unique and attractive hairstyles. It will be appreciated that many other hair styles may be created with the article of the present invention through variations on the techniques illustrated above, as well as through other techniques. For example, small pairs of strips can be used to create a collection of miniature buns arranged in a sequence from ear to ear across the crown of the head, arranged in a cluster in the back of the head, or arranged in various other ways.

In another example, two pairs of strips can be used to create a bun around a ponytail. The variety of possible styles is virtually limitless. It will also be appreciated that the present invention may be used in conjunction with various other hair styling articles such as clips, pins, barrettes, elastic bands, and the like. It is important to note also that the invention may be used with wigs and with doll hair, as well as with real human hair.

A Spring Strips With Attached Elastic Section and Use:

FIGS. 23*a–b* illustrate yet another embodiment of the current invention. FIG. 24*a* shows the device 180 with one spring strip 181 and a stretchable section 183 attached to and near the ends 185 and 185' of the spring strip 110. The stretchable section 183 may be permanently attached to the spring strip 181 or removably attached to the spring strip 181 by any means known in the art, such as with rivets, two piece snaps and the like. While it is preferred that the stretchable section 124 is attached at the ends 185 and 185' of the spring strip 181, it may also be attached at various positions on the surface 187 of the spring strip. Further, a plurality of sections of stretchable material attached at various positions along the surface 187 of the spring strip 181 is considered to be within the scope of the current invention. The stretchable section 183 is preferably attached to the concave outer coiling surface 187 of the spring strip 181 and is made from any material or combination of materials that is/are capable to hold sections of hair during styling. Suitable materials for the stretchable section 124 include, but are not limited to elastic, cloth-covered elastic and rubber materials. FIG. 24*b* illustrates a strand or section of hair 189 positioned and sandwiched between the spring strip 181 and the stretchable section 124. The device 180 (shown in FIG. 24*a*) is used to create several hairstyles similar to those described above for pairs of strips.

Figure 25:
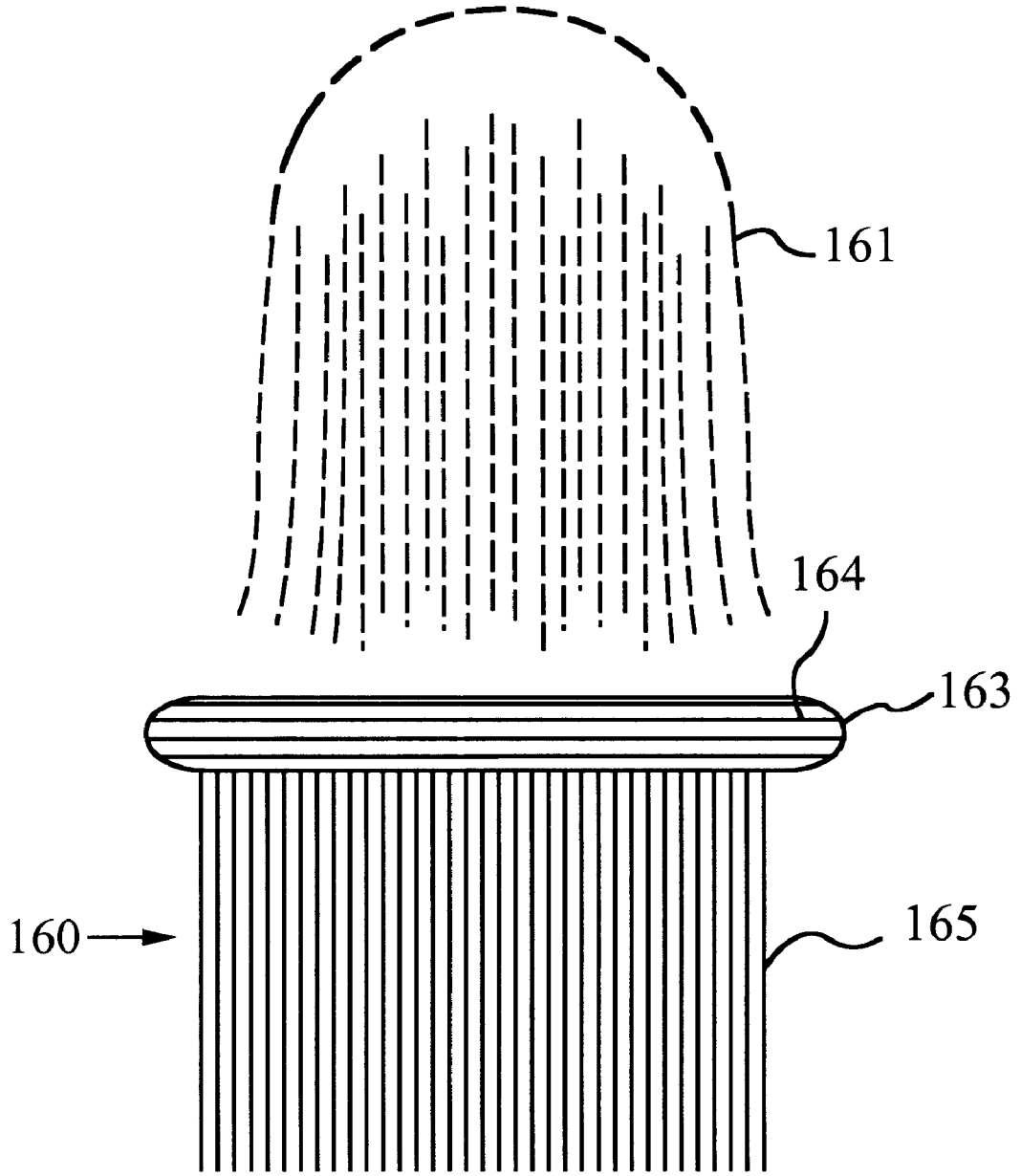
FIG. 25 illustrates a hair styling device with hair attachments connected to a spring strip.
Figure 26:
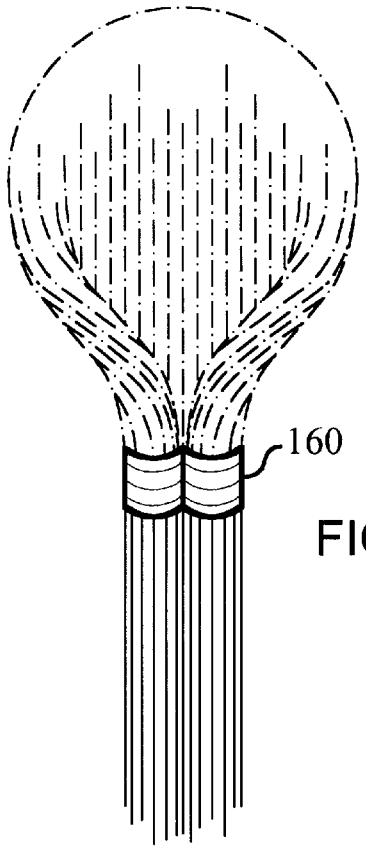
FIG. 26 illustrates one implementation of a hair styling device with hair attachments connected to a spring strip
Figure 27:
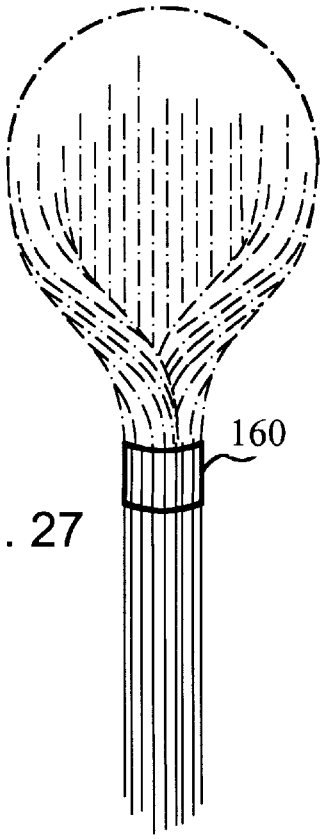
FIG. 27 illustrates an alternative implementation of a hair styling device with hair attachments connected to a spring strip.

Spring Strips with Extenders and Use:

FIG. 25 illustrates an alternative embodiment of the current invention, where the hair styling device 167 has hair extenders 165 attached to at least one of the spring strips 163 and 164. The hair 161 is posited between the strips as in the previous embodiments described above. The strips 163/164, are then coiled as shown in FIGS. 26–27. In FIG. 26, the strips are coiled according to FIGS. 17*a*–*d* and in FIG. 27; the strips are coiled concurrently as shown in FIG. 3.

Figure 28A:
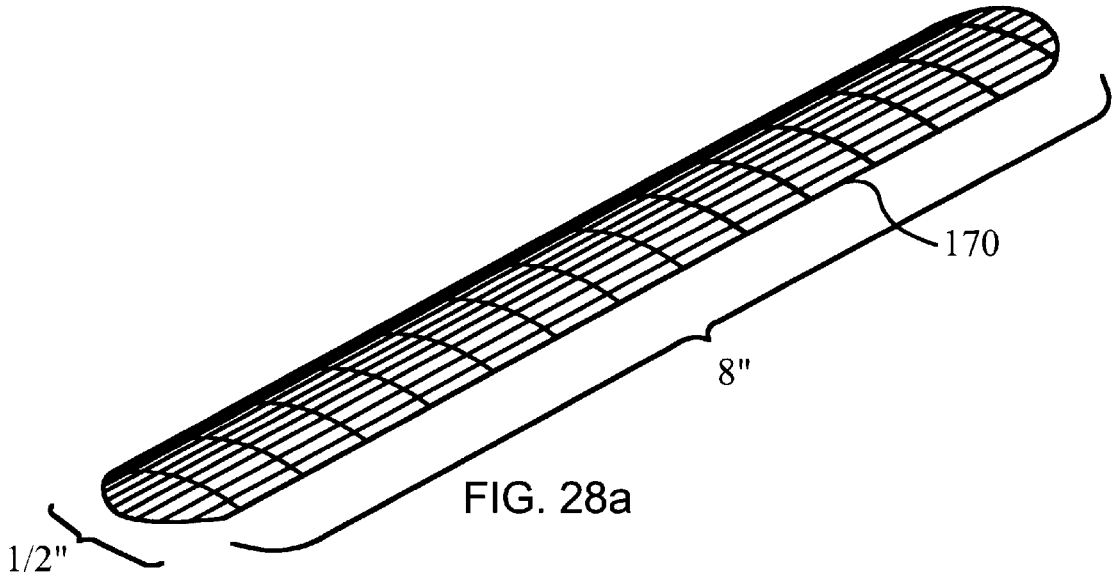
FIGS. 28*a–b* illustrates the preferred dimensions of a hair stick spring strip and an implementation of a hair stick spring strip.
Figure 28B:
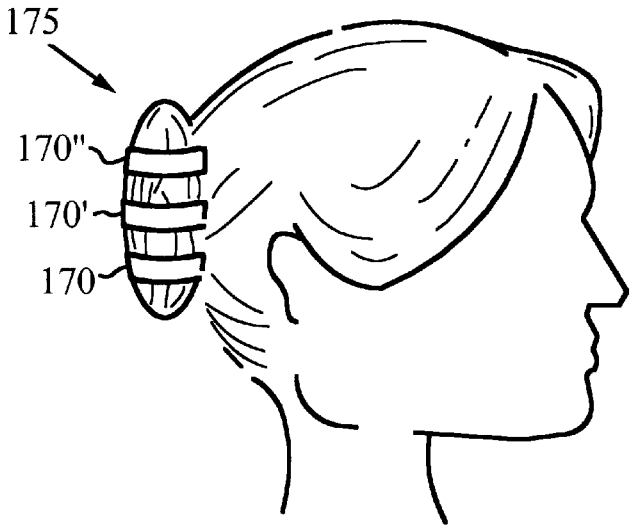

Hair stick Spring Strips and Use:

FIGS. 28*a*–*b* illustrate an alternative embodiment of the current invention, whereby a long spring strip 170 (shown in FIG. 28*a*) is used as hair stick. The hair stick 170 is capable of being pushed through a section of hair and coiled around the section of hair. The hair stick spring strip is preferably 8 inches or longer and has a width between ½ to ⅜ inches. FIG. 28*b* illustrates one implementation of the hair stick spring strips, where a plurality of hair stick strips 170, 170' and 170" are pushed through a bunch of hair and coiled around a section of hair to hold a desired style 175.

It will be clear to one skilled in the art that the above embodiments may be altered in many ways without departing from the scope of the invention. Accordingly, the scope of the invention should be determined by the following claims and their legal equivalents.

What is claimed is:

1. A method of holding a section of hair in styled configuration, said method comprising the steps of:

a) providing a first self-coiling spring member with a first inner coiling surface and a first outer coiling surface, wherein said first self-coiling spring member has an extended open state and a coiled closed state;

b) holding said first inner coiling surface against said section of hair with said first self-coiling spring member in said extended open state;

c) releasing said first self-coiling spring member from said extended open state to said coiled closed state;

d) wrapping an elastic loop member around a piece carbon spring steel with said piece carbon spring steel in said coiled closed state; and whereby said first self-coiling spring member coils around said section of hair and holds said section of hair in said styled configuration.

2. The method of claim 1 wherein said piece carbon spring steel comprises a plurality of elongated spring fingers that coil around said section of hair.

3. A method of holding a section of hair in styled configuration, said method comprising the steps of:

a) providing a first self-coiling spring member with a first inner coiling surface and a first outer coiling surface, wherein said first self-coiling spring member has an extended open state and a coiled closed state;

b) holding said first inner coiling surface against said section of hair with said first self-coiling spring member in said extended open state;

c) rolling said self coiling spring member around said section of hair with said self-coiling spring member in said extended open state, whereby said self-coiling spring member styles said section of hair; and d) releasing said first self-coiling spring member from said extended open state to said coiled closed state;

whereby said first self-coiling spring member coils around said section of hair and holds said section of hair in said styled configuration.

4. A method of holding a section of hair in styled configuration, said method comprising the steps of:

a) providing a first self-coiling spring member with a first inner coiling surface and a first outer coiling surface, wherein said first self-coiling spring member has an extended open state and a coiled closed state; and b) holding said first inner coiling surface against said section of hair with said first self-coiling spring member in said extended open state;

c) providing a flattened flexible member with a shape substantially similar to said first self-coiling spring member; and d) sandwiching said portion of hair between said flexible member and said first self-coiling member; and e) releasing said first self-coiling spring member from said extended open state to said coiled closed state;

whereby said first self-coiling spring member coils around said section of hair and holds said section of hair in said styled configuration.

5. The method of claim 4, wherein said first self-coiling spring member and said flexible member are elongated with widths between 0.5 and 3.0 inches and a lengths between 4.0 to 12 inches.

6. The method of claim 5, further comprising the step f) of attaching said first self-coiling spring member and said flexible prior to step e).

7. The method of claim 5, further comprising the step f) of rolling said first self coiling spring member and said flexible member around said section of hair with said first self-coiling spring member in said extended open state prior to step c), whereby said first self-coiling spring member and said flexible member style said section of hair.

8. The method of claim 5, wherein said flexible member is a second self-coiling spring member.

9. The method of claim 8, wherein said second self-coiling spring member is a piece carbon spring steel and said extended open state corresponds to and equilibrium high energy state, said closed coiled state corresponds to a low energy state.

10. A device for securing a section of hair in a styled configuration by coiling around a portion of said section of hair, said device comprising a) a piece of carbon spring steel with an stable elongated open state and a coiled closed state, wherein said piece of carbon spring steel has surfaces comprising an outer coiling surface and an inner coiling surface;

b) a means for holding said section of hair, wherein said means for holding said section of hair is attached to at least one of said surfaces of said piece of carbon spring steel; and wherein said means for holding said section of hair is an elastic loop member.

11. The device of claim 10, wherein said elastic loop member is attached to said inner coiling surface of said carbon spring steel.

12. A device for securing a section of hair in a styled configuration by coiling around a portion of said section of hair, said device comprising a) a piece of carbon spring steel with an stable elongated open state and a coiled closed state, wherein said piece of carbon spring steel has surfaces comprising an outer coiling surface and an inner coiling surface;

b) a means for holding said section of hair, wherein said means for holding said section of hair is attached to at least one of said surfaces of said piece of carbon spring steel; and wherein said means for holding said section of hair is a flattened flexible member with a shape that is similar to said piece of carbon spring steel for sandwiching said portion of hair between said flexible member and said inner coiling surface.

13. The device of claim 12, wherein said piece of carbon spring steel and said flexible member are attached.

14. The device of claim 12, wherein said flexible member is a piece of memory plastic.

15. The devices of claim 12, wherein said piece of carbon spring steel is elongated and said flexible member is a second piece of carbon spring steel.

16. A device for securing a section of hair in a styled configuration by coiling around a portion of said section of hair, said device comprising a) a piece of carbon spring steel with an stable elongated open state and a coiled closed state, wherein said piece of carbon spring steel has surfaces comprising an outer coiling surface and an inner coiling surface;

b) a means for holding said section of hair, wherein said means for holding said section of hair is attached to at least one of said surfaces of said piece of carbon spring steel; and wherein said means for holding said section of hair is an elongated stretchable section attached carbon spring steel.

17. The device of claim 16, wherein said stretchable section is attached to at least to places on said outer coiling surface of said carbon spring steel.

18. A device for securing a section of hair in a styled configuration by coiling around a portion of a section of hair, said device comprising a first piece of carbon spring steel with an stable elongated open state and a coiled closed state, wherein said piece of carbon spring steel has surfaces comprising an outer coiling surface and an inner coiling surface and wherein said spring steel is activated to coil by applying a pressure of 2.0 pounds or greater to said inner coiling surface, said device further comprising:

a) a second elongated carbon steel spring; and b) a body section through which said first elongated carbon steel spring and said second elongated carbon steel spring are attached such that said first and said second carbon steel spring coil in substantially in the same direction and are capable of coiling around separate portions of said section of hair said plurality of finger coil around portions of said section of hair.

* * * * *